US008192213B2

(12) United States Patent
Braden et al.

(10) Patent No.: US 8,192,213 B2
(45) Date of Patent: Jun. 5, 2012

(54) ELECTRICAL CONDUCTION ACROSS INTERCONNECTED TUBULARS

(75) Inventors: Jason Braden, Pearland, TX (US); Brian Clark, Sugar Land, TX (US)

(73) Assignee: Intelliserv, LLC, Houston, TX (US)

( * ) Notice: Subject to any disclaimer, the term of this patent is extended or adjusted under 35 U.S.C. 154(b) by 0 days.

(21) Appl. No.: 12/604,745

(22) Filed: Oct. 23, 2009

(65) Prior Publication Data

US 2011/0094729 A1 Apr. 28, 2011

(51) Int. Cl.
*H01R 4/60* (2006.01)
*H01R 4/64* (2006.01)

(52) U.S. Cl. ..... 439/194

(58) Field of Classification Search ..... 439/191–195, 439/950

See application file for complete search history.

(56) References Cited

U.S. PATENT DOCUMENTS

| | | | | |
|---|---|---|---|---|
| 3,807,502 | A | 4/1974 | Heilhecker et al. | |
| 3,957,118 | A | 5/1976 | Barry et al. | |
| 4,126,848 | A | 11/1978 | Denison | |
| 4,605,268 | A | 8/1986 | Meador | |
| 4,806,928 | A | 2/1989 | Veneruso | |
| 4,901,069 | A | 2/1990 | Veneruso | |
| 5,052,941 | A | 10/1991 | Hernandez-Marti et al. | |
| 5,278,550 | A | 1/1994 | Rhein-Knudsen et al. | |
| 5,531,592 | A | 7/1996 | Tasi | |
| 5,624,051 | A | 4/1997 | Ahern, Jr. et al. | |
| 5,971,072 | A | 10/1999 | Huber et al. | |
| 6,223,826 | B1 | 5/2001 | Chau et al. | |
| 6,641,434 | B2 | 11/2003 | Boyle et al. | |
| 6,763,887 | B2 * | 7/2004 | Boyadjieff | 166/302 |
| 6,866,306 | B2 | 3/2005 | Boyle et al. | |
| 7,397,388 | B2 | 7/2008 | Huang et al. | |
| 2004/0221995 | A1 | 11/2004 | Hall et al. | |
| 2005/0168349 | A1 * | 8/2005 | Huang et al. | 340/854.3 |
| 2007/0030762 | A1 * | 2/2007 | Huang et al. | 367/83 |
| 2008/0041575 | A1 | 2/2008 | Clark et al. | |
| 2008/0110638 | A1 | 5/2008 | Hall et al. | |

FOREIGN PATENT DOCUMENTS

| | | |
|---|---|---|
| RU | 2040691 | 7/1995 |
| RU | 2140527 | 10/1999 |
| WO | 90/14497 | 11/1990 |

OTHER PUBLICATIONS

W.J. McDonald, "Four Different Systems Used for MWD," Oil & Gas Journal, pp. 115-124 (Apr. 3, 1978).

International Application No. PCT/US2010/048935 Search Report and Written Opinion dated Apr. 20, 2011.

* cited by examiner

*Primary Examiner* — Javaid Nasri
(74) *Attorney, Agent, or Firm* — Conley Rose, P.C.

(57) ABSTRACT

A wired tubular string includes a first joint having an axial bore, a box end, a pin end, a concentric inner conductor, and a concentric outer conductor; a second joint having an axial bore, a box end, a pin end, a concentric inner conductor and a concentric outer conductor; a joint-to-joint connection formed at the connection of the pin end of the second joint with the box end of the second joint; and an isolation assembly positioned at the joint-to-joint connection to operationally connect the corresponding concentric inner conductors and the correspond concentric outer conductor across the joint-to-joint connection and electrically isolate the inner conductor from the outer conductor.

14 Claims, 28 Drawing Sheets

ELECTRICAL CONDUCTION ACROSS INTERCONNECTED TUBULARS

BACKGROUND

Wellbores are drilled to locate and produce hydrocarbons. A downhole drilling tool with a bit at one end thereof is advanced into the ground via a drill string to form a wellbore. The drill string and the downhole tool are typically made of a series of drill pipes threadably connected together to form a long tube with the bit at the lower end thereof. As the drilling tool is advanced, a drilling mud is pumped from a surface mud pit, through the drill string and the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to provide communication between the surface and the downhole tool. Wellbore telemetry devices are typically used to allow, for example, power, command and/or communication signals to pass between a surface unit and the downhole tool. These signals are used to control and/or power the operation of the downhole tool and send downhole information to the surface.

Various wellbore telemetry systems may be used to establish the desired communication capabilities. Examples of such systems may include a wired drill pipe wellbore telemetry system as described in U.S. Pat. No. 6,641,434, an electromagnetic wellbore telemetry system as described in U.S. Pat. No. 5,624,051, and an acoustic wellbore telemetry system as described in PCT Patent Application No. WO2004085796, the entire contents of which are hereby incorporated by reference. Other data conveyance or communication devices, such as transceivers coupled to sensors, may also be used to transmit power and/or data.

With wired drill pipe ("WDP") telemetry systems, the drill pipes that form the drill string are provided with electronics capable of passing a signal between a surface unit and the downhole tool. As shown, for example, in U.S. Pat. Nos. 6,641,434 and 6,866,306 to Boyle et al. and incorporated by reference in their entirety, such wired drill pipe telemetry systems can be provided with wires and inductive couplings that form a communication chain that extends through the drill string. The wired drill pipe is then operatively connected to the downhole tool and a surface unit for communication therewith. The wired drill pipe system is adapted to pass data received from components in the downhole tool to the surface unit and commands generated by the surface unit to the downhole tool. Further documents relating to wired drill pipes and/or inductive couplers in a drill string are as follows: U.S. Pat. Nos. 4,126,848, 3,957,118 and 3,807,502, the publication "Four Different Systems Used for MWD," W. J. McDonald, The Oil and Gas Journal, pages 115-124, Apr. 3, 1978, U.S. Pat. No. 4,605,268, Russian Federation Published Patent Application 2140527, filed Dec. 18, 1997, Russian Federation Published Patent Application 2,040,691, filed Feb. 14, 1992, WO Publication 90/14497A2, U.S. Pat. Nos. 5,052,941, 4,806,928, 4,901,069, 5,531,592, 5,278,550, and 5,971,072.

With the advent and expected growth of wired drill pipe technology, connections between adjoining drill pipes will be a continued source of improvement.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
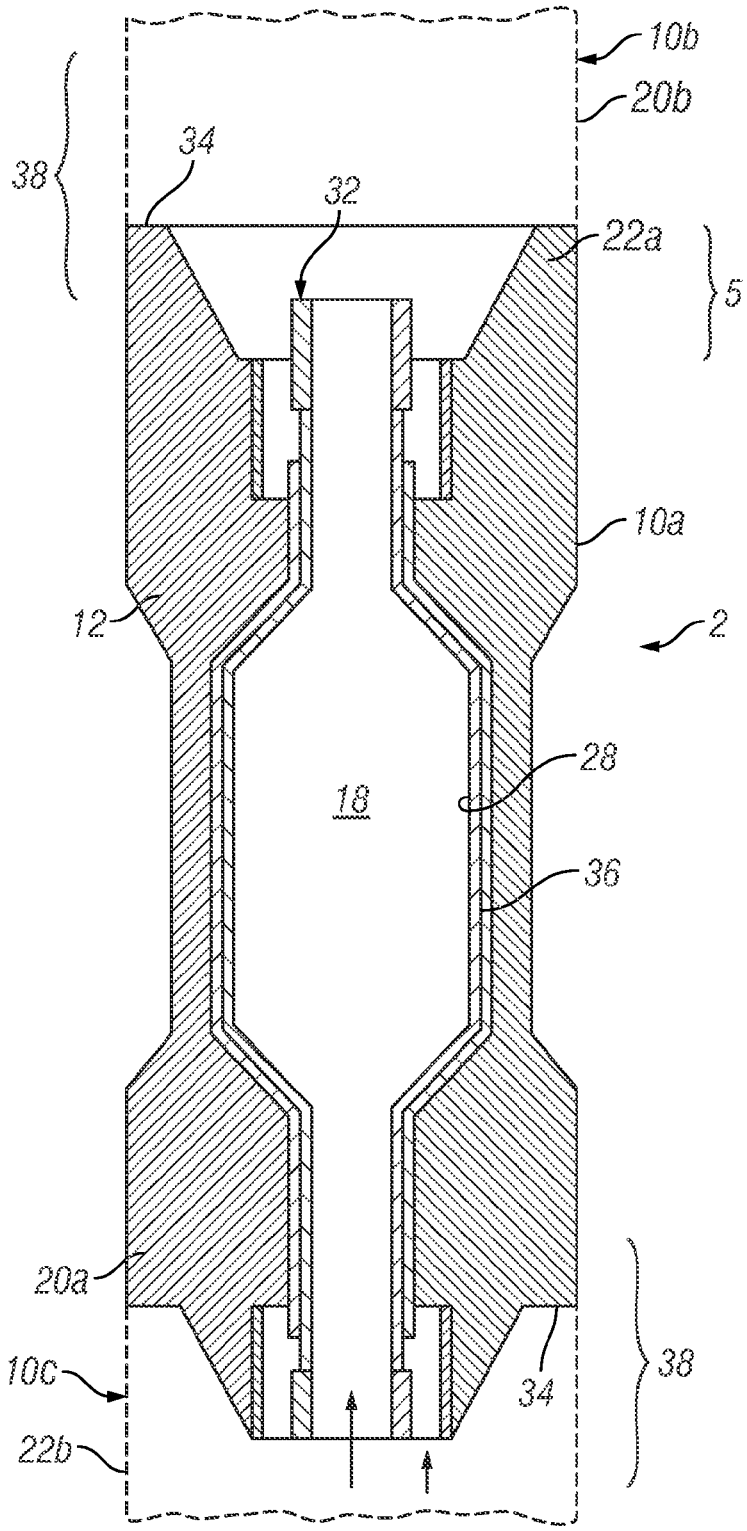
FIG. 1 is a cross-section conceptual view of a string of interconnected wired pipe joints utilizing an example of an electrical seal assembly of the present invention.

Refer now to the drawings wherein depicted elements are not necessarily shown to scale and wherein like or similar elements are designated by the same reference numeral through the several views.

FIG. 1 is a cross-section view of an example of a wired drill pipe string, generally denoted by the numeral 2. "Wired drill pipe" or "WDP" is used herein to mean one or more tubular members, including drill pipe, drill collars, casing, tubing and other conduit, that are adapted for use in a drill string. The wired drill pipe 2 has a communication channel extending therethrough for transmitting data and/or electrical signals. Examples of the present invention will be described herein with reference to a drill pipe and drill strings. While the invention is not limited to drill pipe, the drill pipe joint and string examples shown herein provide an efficient manner of describing various structure, function and benefits. A person having ordinary skill in the art will appreciate that the spirit of the present invention may be applied to casing, drill collars, and other conduits.

The wired drill string 2 (hereinafter "the string 2") may include two or more substantially identical wired tubulars 10*a*, 10*b* interconnected with a joint-to-joint connection (indicated by the dashed lines) to form the wired drill string 2 having at least two electrical communication paths formed along its length. For purposes of description herein, "tubular" will often be replaced with drill pipe or joint to more efficiently describe the present invention with respect to an example of drill pipe for use in a wellbore.

Each joint 10*a* defines a bore 18 extending between a pin end 20*a* and a box end 22*a*. Pin end 20*a* is adapted to mate with box end 22*b* of the adjacent joint in string 2 to form joint-to-joint connections 5. As will be provided further below, each conductive path has concentric contacts at ends 20*a*, 20*b* and 22*a*, 22*b* for completing the electrical path across the pin and box connection of adjacent joints 10*a*, 10*b*.

In the illustrated examples, each joint 10*a*, 10*b* includes at least two conductors identified as an outer conductor 12 and an inner conductor 28 that are electrically separated by an insulating layer 36 and electrical seal or isolation assembly. Joints 10*a*, 10*b* include a seal assembly, such as an electrical seal assembly, generally denoted by the numeral 38. Seal assembly 38 facilitates an operational connection of the adjacent tubular joints 10*a*, 10*b* wherein each electrical path is completed across the connection and the separated electrical paths are electrically isolated from one another across the connection. It is noted that electrical seal assembly 38 provides electrical isolation and may not provide pressure, or hydraulic, isolation. From time to time herein, reference may be made to "operational connection," "functional connection," or other similar language with reference to the connection of adjacent joints 10*a*, 10*b*. These terms are intended to mean that an electrical connection is achieved across the connection to corresponding conductors and that electrical isolation is achieved between the non-corresponding conductors (i.e. conductor 12 and 28).

In the illustrated examples, outer conductor 12 is formed of the tubular body of joint 10 between outer contacts 34 forming a first electrical path. Outer contacts 34 may be referred to by position as a first and second, box end and pin end, or other similar terms to identify that they are corresponding ends. Outer contacts 34 are each concentrically aligned around bore 18. Inner conductor 28 in the illustrated examples is positioned on a wall defining bore 18 providing a second electrical path between a first inner contact 30 and second inner contact 34.

To interconnect tubulars 10*a*, 10*b*, pin end 20*a* is stabbed into box end 22*b* and made-up. In borehole drilling operations tubulars 10*a*, 10*b* will typically be made-up with power tongs. Concentric outer contacts 34 of conductor 12 are aligned so as to complete the electrical path through conductor 12 across the tubular connection, and inner contacts 30 and 32 will complete the electrical path through conductor 28. Seal assembly 38 is provided to electrically isolate conductor 12 from conductor 28 at the connection of pin end 20 and box end 22. Examples of seal assembly 38 and mechanisms for providing an operational connection between wired pipe joints 10 are described in more detail with reference to FIGS. 2-23.

Figure 2:
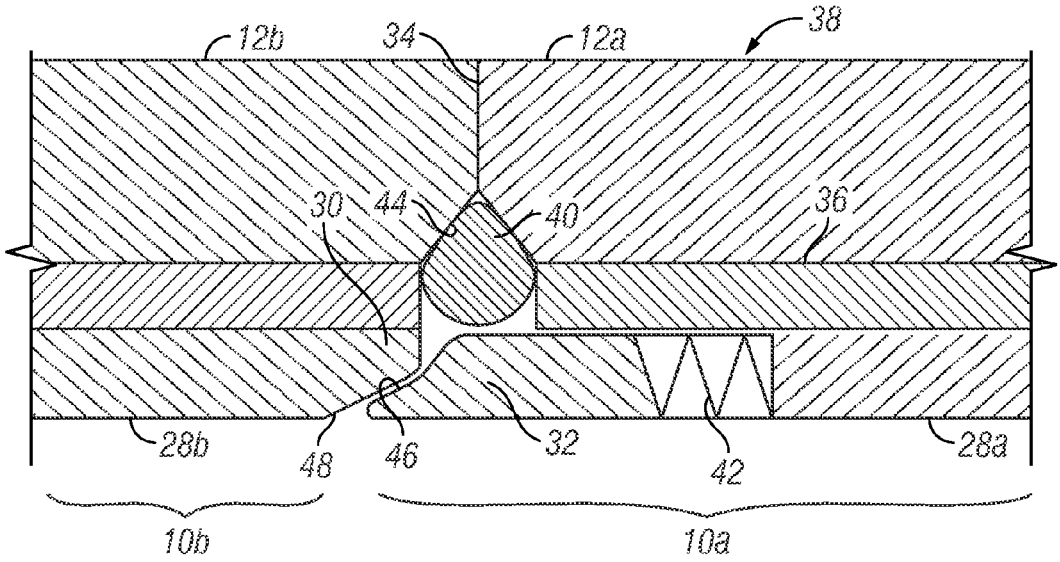
FIG. 2 is a cross-section view of a joint-to-joint connection utilizing an example of an electrical seal assembly that allows electrical communication across the connection between the corresponding first conductor sections of the joints and the second corresponding conductor sections of the joints and electrically separating the first conductor from the second conductor.

Refer now to FIG. 2, wherein an example of a portion a seal assembly 38 is shown in isolation. Seal assembly 38 includes a sealing element 40 positioned between outer conductor 12*a*, 12*b* and inner conductor 28*a*, 28*b* to electrically isolate conductor 12*a*, 12*b* from conductor 28*a*, 28*b*. Sealing element 40 is positioned on the non-conductive surface of insulating layer 36, and may be formed from or on insulating layer 36. Sealing element 40 may be an o-ring, a square seal, quad seal, or other shaped seal or replaceable formed seal member. Sealing element 40 may be constructed of any suitable electrically insulating material including elastomer, plastic or metal.

Outer conductors 12*a*, 12*b* include chamfers 44 to squeeze sealing element 40 between inner conductor 28*a*, 28*b* and insulating layer 36. A spring force, indicated generally by numeral 42, provides a force to maintain the connection between the inner contacts 30, 32. First inner contact 30 and second inner contact 32 may have mating interfaces or may otherwise be shaped to facilitate coupling between the two contacts. For example, second inner contact 32 may include tapered contact face 46 with respect to first inner contact 30. The first inner contact 30 may also include tapered contact face 48 with respect to second inner contact 32. Tapered contact face 46 and/or tapered contact face 48 may amplify spring force 42 to provide a greater contact force between second inner contact 32 and first inner contact 30. This greater contact force may reduce the contact resistance and improve electrical performance of the wired drill pipe assembly. Tapered contact face 46 and/or tapered contact face 48 may facilitate or maintain the alignment of second inner contact 32 and first inner contact 30 during operation, e.g., under shocks and vibrations.

Figure 3A:
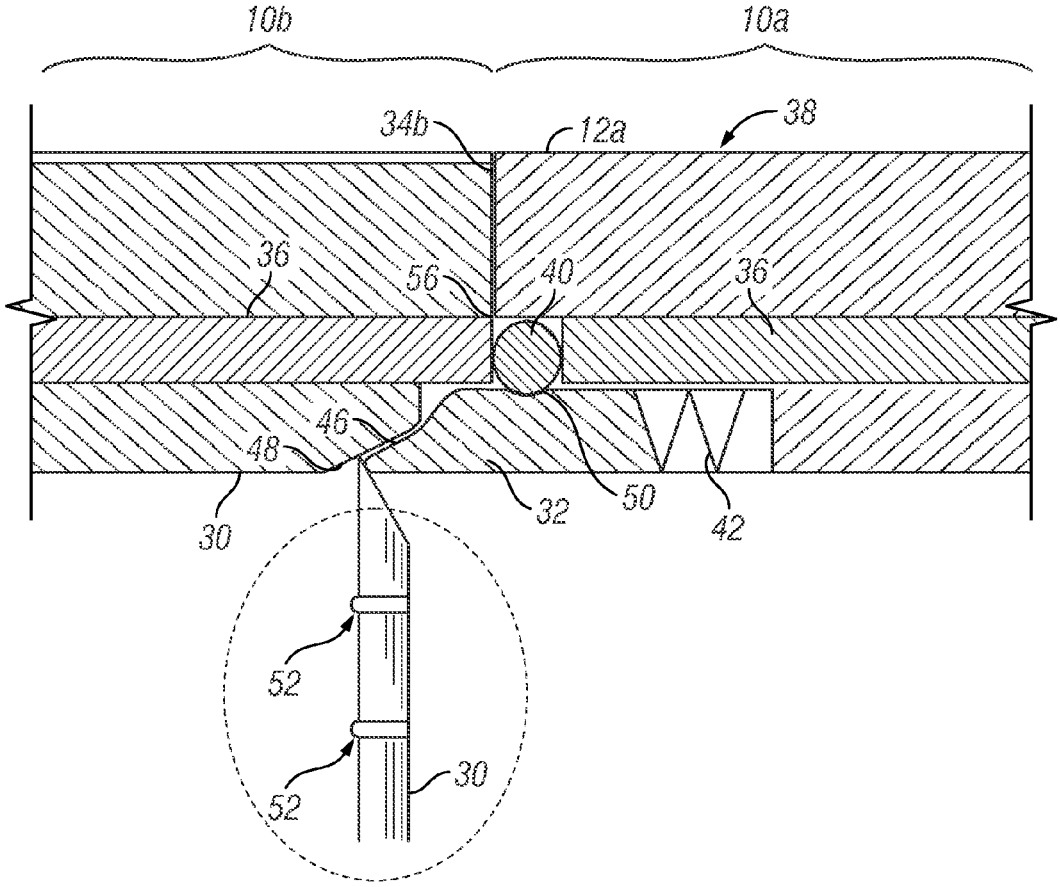
FIGS. 3A-3F are cross-section views of a joint-to-joint connection utilizing another example of an electrical seal assembly.
Figure 3B:
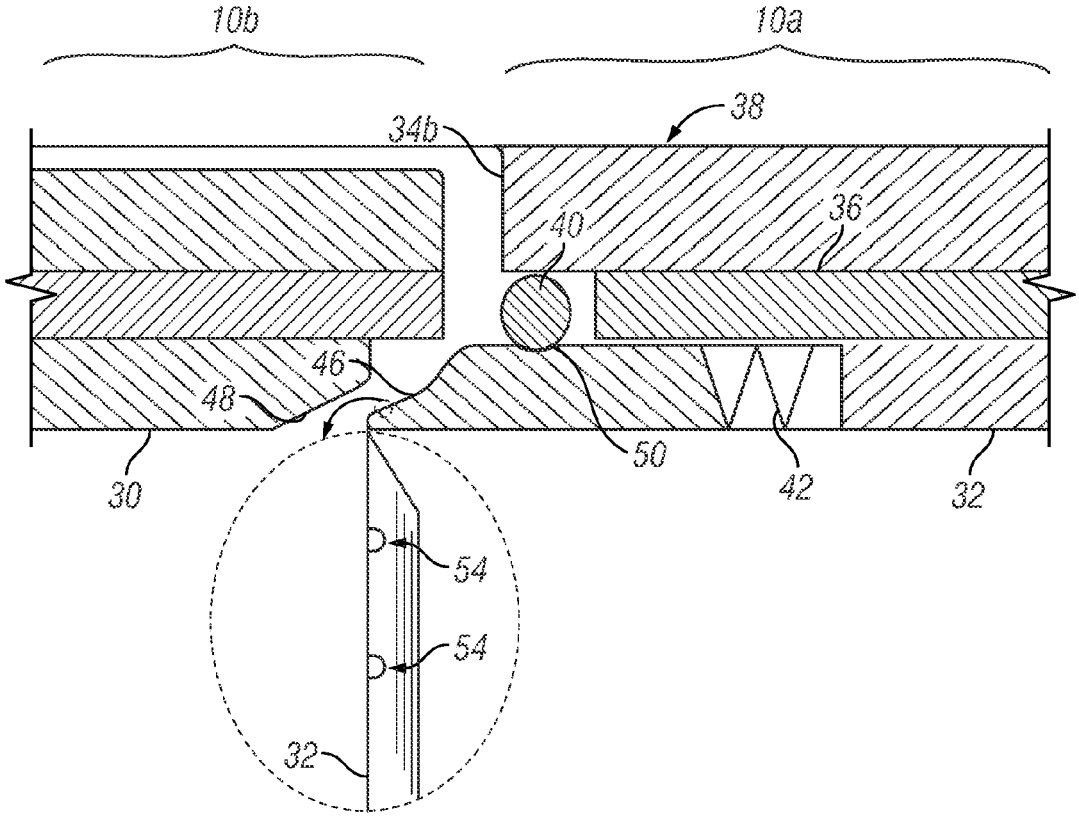

FIGS. 3A and 3B show another example of seal assembly 38 in closed and open positions, respectively. As used herein, the seal assembly 38 is in a closed position when the seal assembly 38 is in a substantially sealed position, e.g., contacts 30 and 32 are substantially compressed together. An example of the closed position is shown in FIG. 3A. The seal assembly 38 is in an open position when the seal assembly 38 is in a substantially open position, e.g., contacts 30 and 32 are not substantially compressed together. FIG. 3B illustrates an example of the open position. The second inner contact 32 includes recess 50 to maintain and/or secure the sealing element 40 in position until the connection between joints 10*a* and 10*b* is established. The recess 50 may be shaped to allow sealing element 40 to slide along the recess 50 once installed. For example, the recess 50 may allow cleaning under the sealing element 40 when re-greasing the connection between joints 10*a* and 10*b*. In this example, outer contacts 34*b* of the seal assembly 38 do not include chamfers because insulating layer 36 and outer conductor 12*a* are shaped to provide cavity 56 for sealing element 40 while the seal assembly 38 is in the closed position.

First inner contact 30 includes grooves or notches 52 on the tapered contact face 48. Similarly, second inner contact 32 includes grooves or notches 54 on tapered contact face 46. The interference of grooves 52 and 54 may help remove debris out from between inner contacts 30 and 32 to provide lower electrical resistance with lower force 42. For example, as joints 10*a* and 10*b* are being screwed together or otherwise connected, grooves 52 and 54 interact to move debris out of the contact area. The size and shapes of the grooves 52 and 54 may be selected based on the debris size, desired rate of debris removal, and required mechanical strength, among other factors. The portions of FIGS. 3A and 3B encircled in dotted lines illustrate an exploded view of the first inner contact 30 (shown in FIG. 3A) and the second inner contact 32 (shown in FIG. 3B.

Figure 3C:
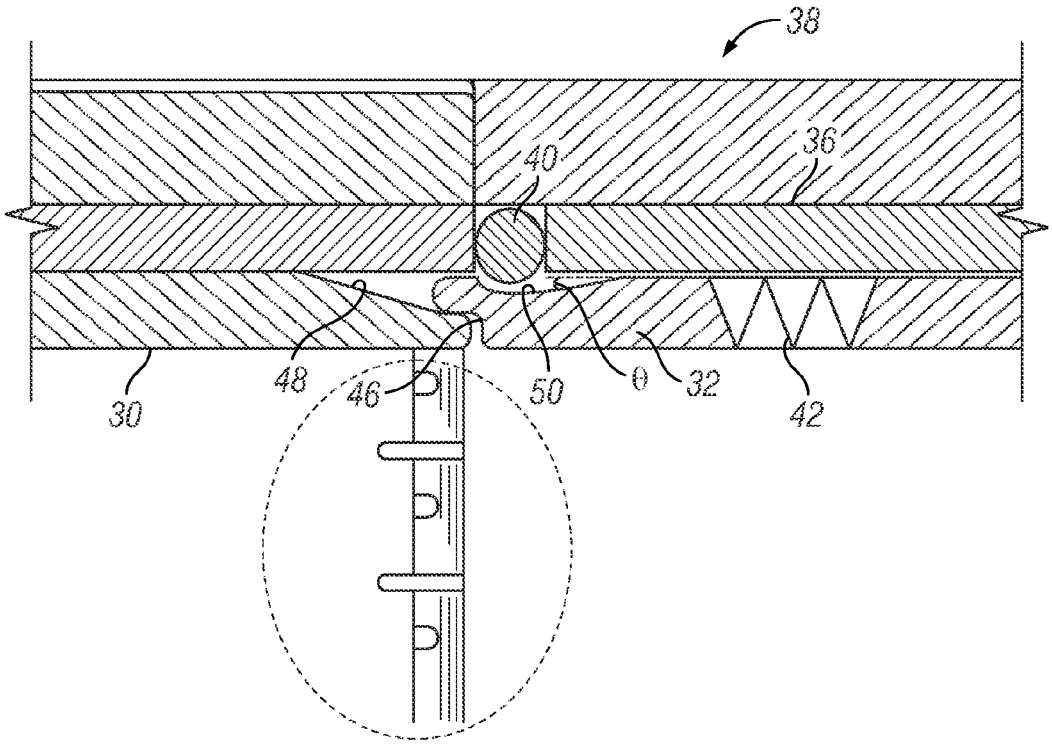
Figure 3D:
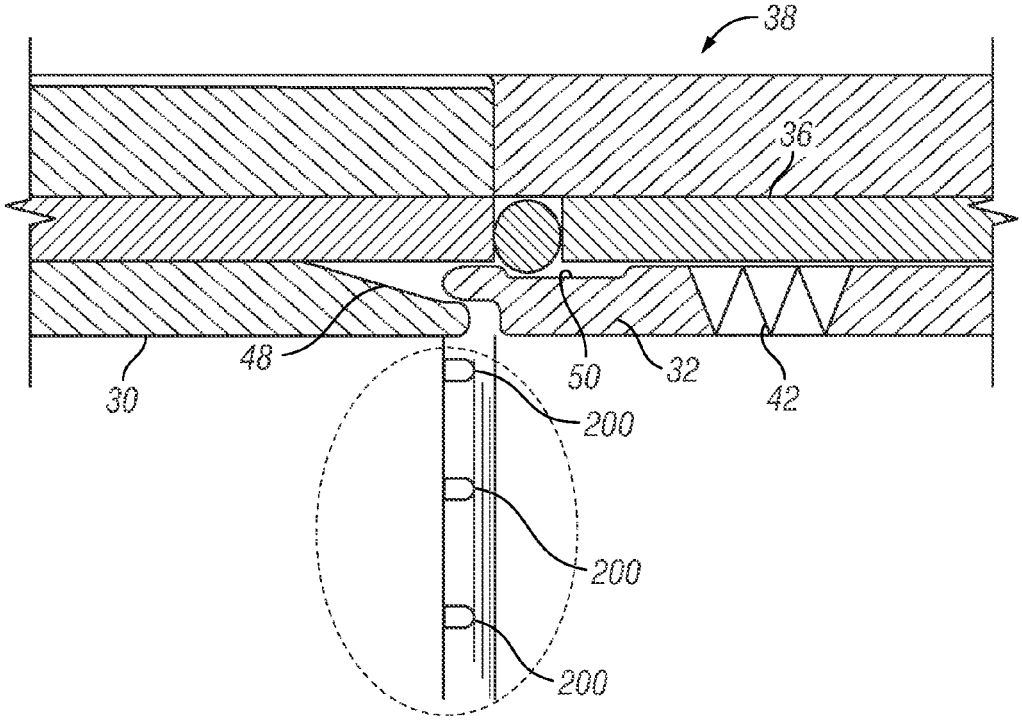
Figure 3E:
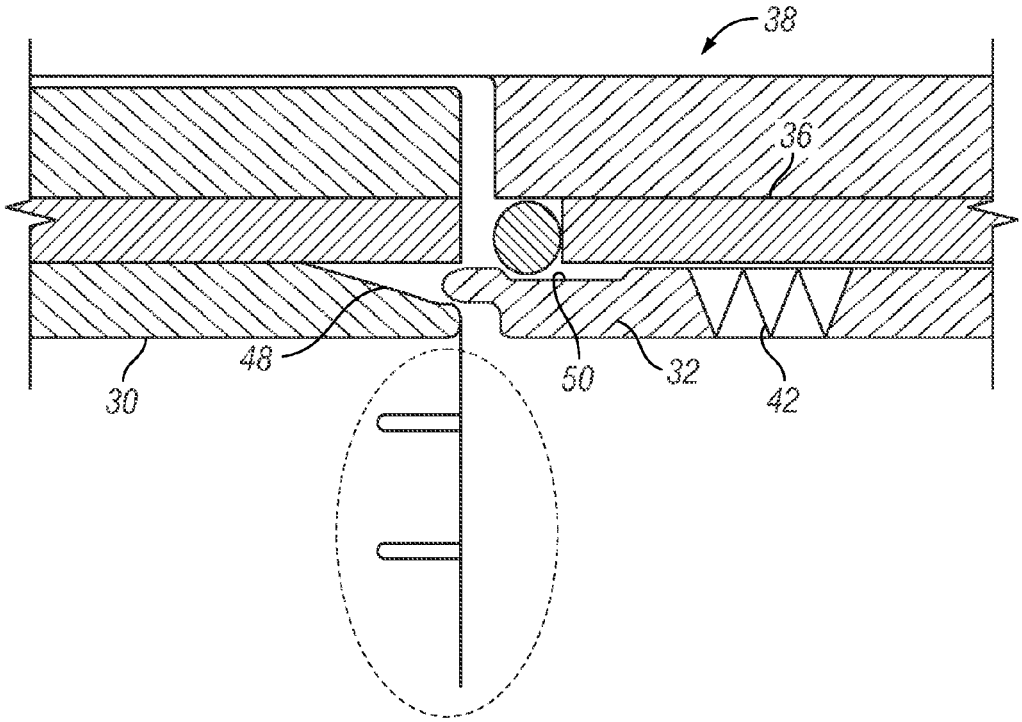

FIG. 3C shows another example of the seal assembly 38 (shown in a closed position). In this example, the recess 50 is a shallow cut or groove having an angle θ to allow sealing element 40 to slide along recess 50. In this example, the taper of contact face 48 is oriented to point downhole (and taper 46 is likewise reversed to couple with taper 48) to reduce the chance of debris piling into the contact area between contacts 30 and 32 during use. The encircled dashed line portion shows an exploded view of the contact face 48 having FIGS. 3D and 3E show another example of the seal assembly 38, in closed and open positions, respectively, where recess 50 is a flat groove.

Figure 3F:
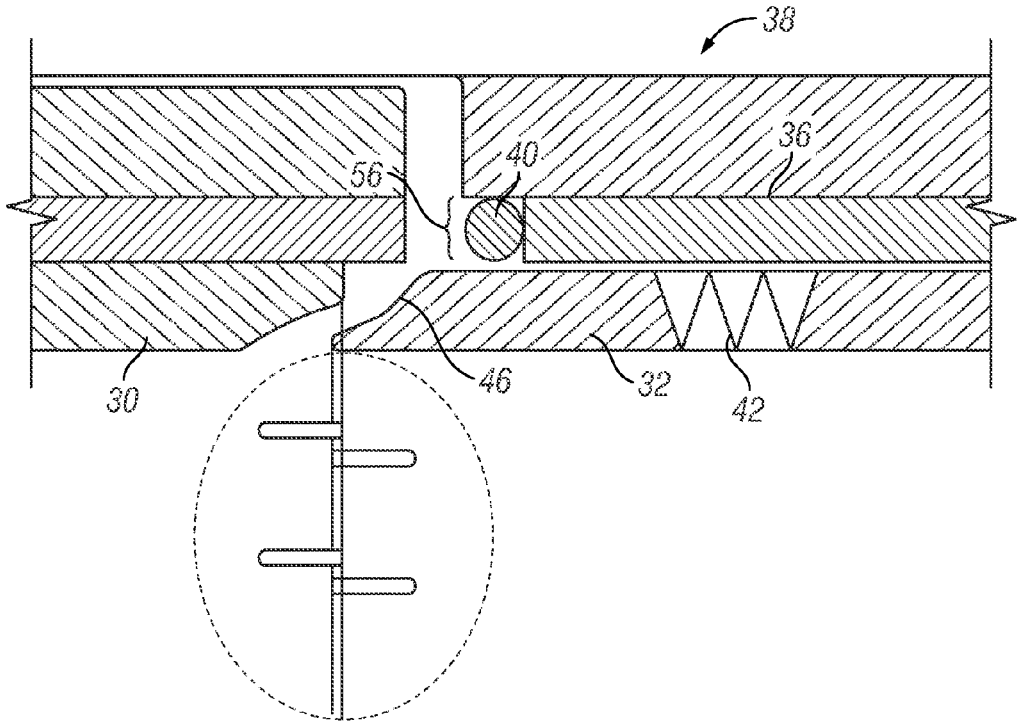

FIG. 3F shows another example of seal assembly 38 in an open position. In this example, seal assembly 38 includes cavity 56 but second inner contact 32 does not include a recess. As shown in FIG. 3F, when second inner contact 32 is fully extended, e.g., during disconnection of joints 10*a* and 10*b*, a smooth outer diameter for sealing element 40 is maintained to avoid tearing or damaging sealing element 40 during inner contact motion.

Figure 4A:
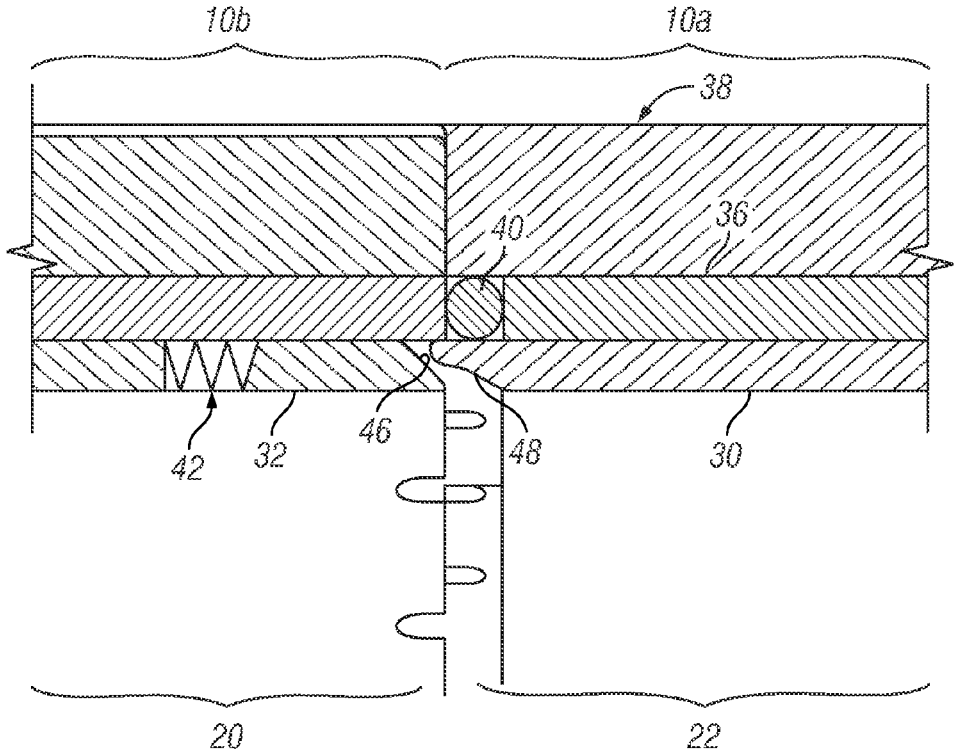
FIG. 4A-4H are cross-section views of a joint-to-joint connection utilizing another example of an electrical seal assembly.

FIG. 4A shows another example of seal assembly 38 in a closed position. In this example, second inner contact 32 is on the pin connection 20 side of the drill pipe connection. With second inner contact 32 on the pin connection 20 side, the taper of contact face 46 is angled to allow debris to fall into the axial bore 18 of joint 10*a*.

Figure 4B:
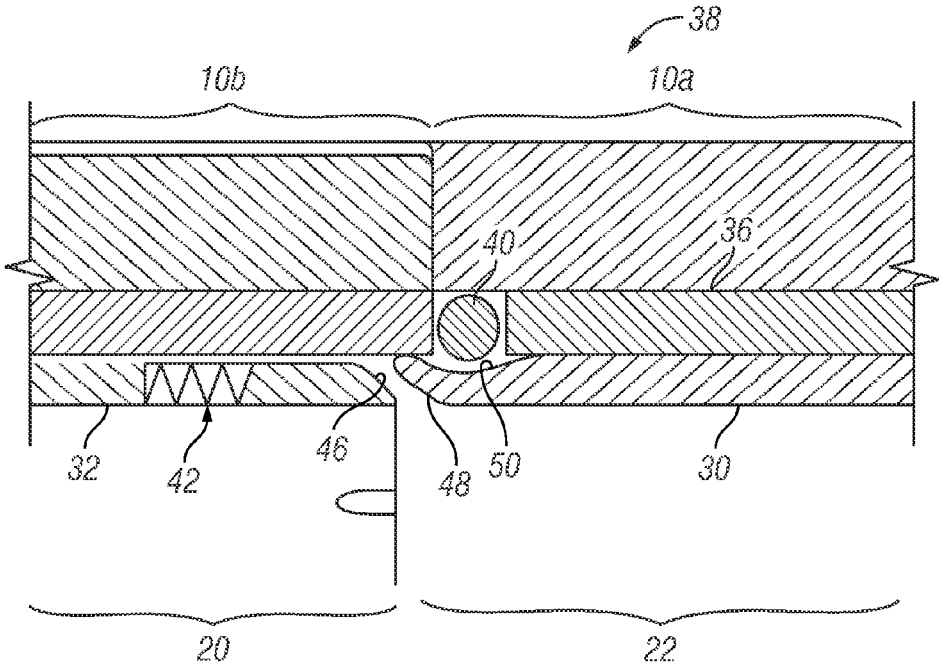

FIG. 4B shows another example of seal assembly 38*f* in a closed position. In this example, first inner contact 30*f* has a ramped tapered contact face 48*f* and recess 50*f*.

Figure 4C:
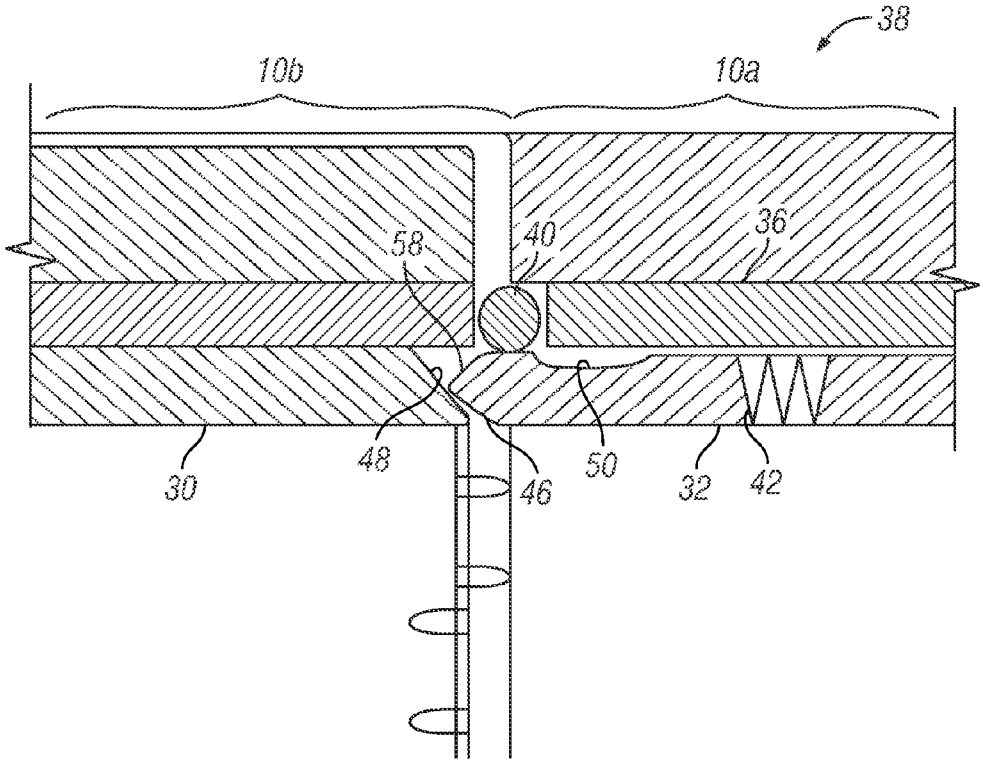

FIG. 4C shows another example of seal assembly 38 in a closed position. In this example, first inner contact 30 has a flat tapered contact face 48 and second inner contact 32 has a tapered face 46 with a rounded tip 58. During operation, rounded tip 58 may slide against flat tapered contact face 48, resulting in a contact force that is maximized with respect to the force change due to the spring force 42 deflection.

Figure 4D:
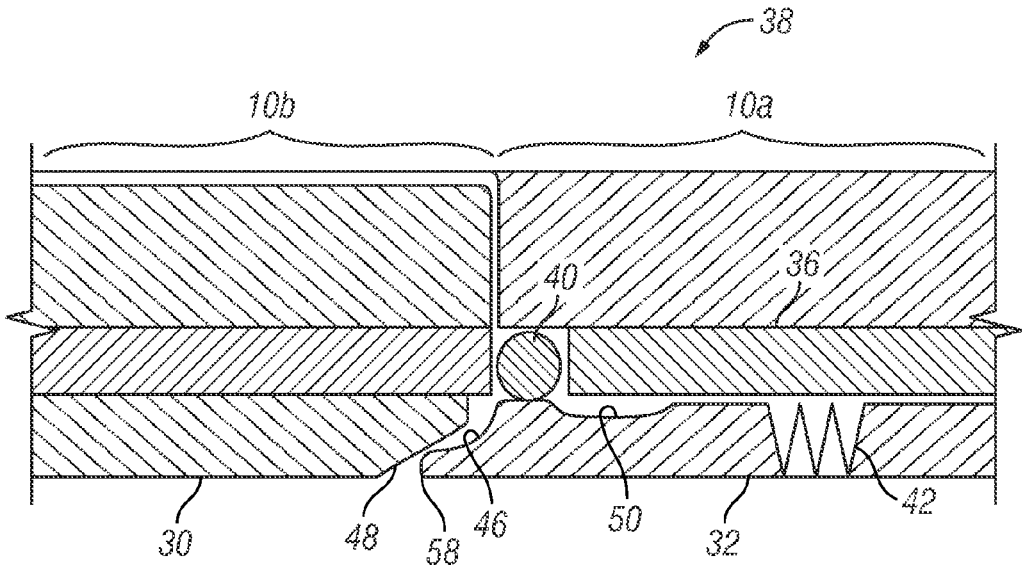

FIG. 4D shows another example of seal assembly 38 in a closed position. In this example, tapered contact face 48 of first inner contact 30 is angled toward the outer diameter, while tapered contact face 46 of second inner contact 32 is angled toward the inner diameter. Tapered contact face 46 has a rounded tip 58.

Figure 4E:
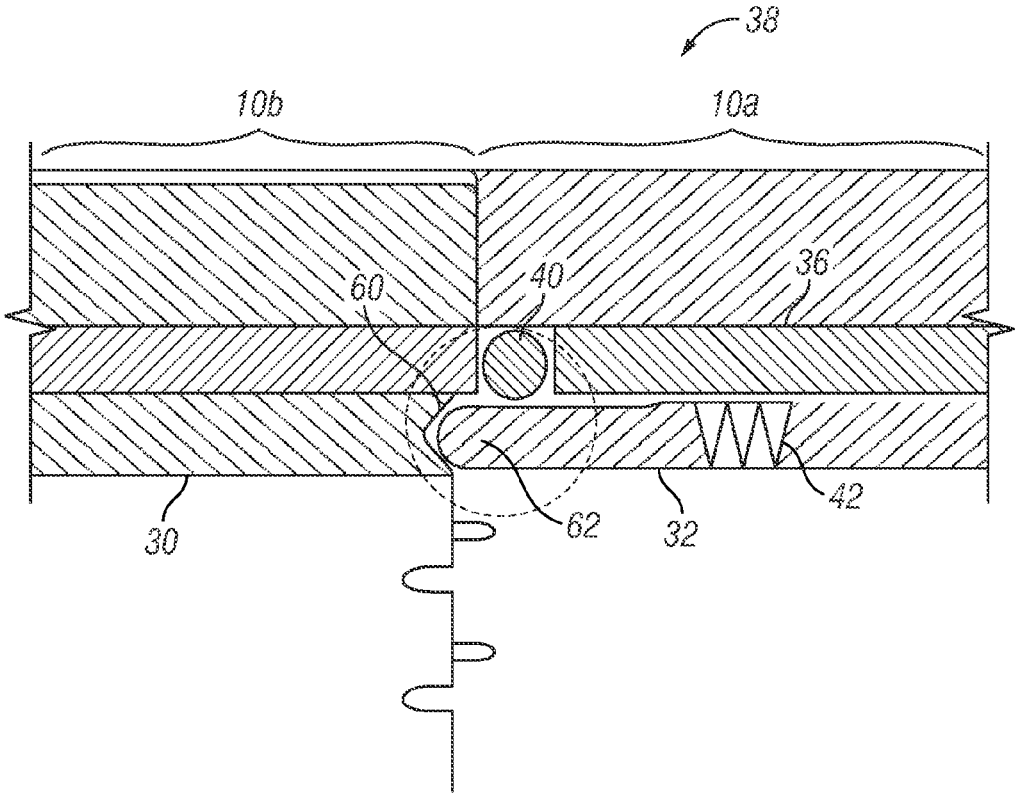
Figure 4F:
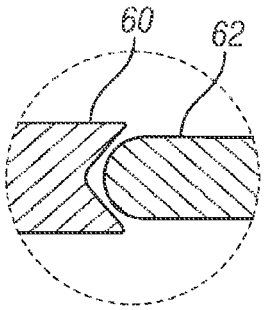
Figure 4G:
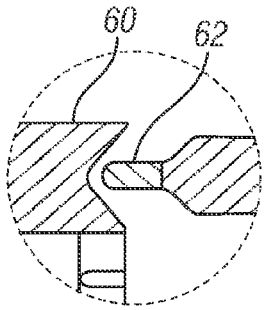
Figure 4H:
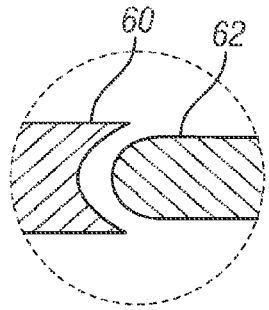

FIG. 4E shows another example of seal assembly 38 in a closed position. In this example, first inner contact 30 has a female contact interface 60 and second inner contact 32 has a male contact interface 62 shaped to couple with female contact interface 60. For example, as shown in FIG. 4F, female contact interface 60 may be V-shaped and male contact interface 62 may have a rounded tip. As shown in FIG. 4G, female contact interface 60 may be V-shaped and male contact interface 62 may have a needle-nosed tip. As shown in FIG. 4H, female contact interface 60 may be U-shaped and male contact interface 62 may have a rounded tip. Where the interfaces 30 and 32 are made from different materials, female and male contact interfaces 60 and 62 allow for deformation of a soft material or accommodation of the manufacturing tolerances of a rigid material by providing two or more contact surfaces between the female and male contact interfaces 60 and 62.

Figure 5A:
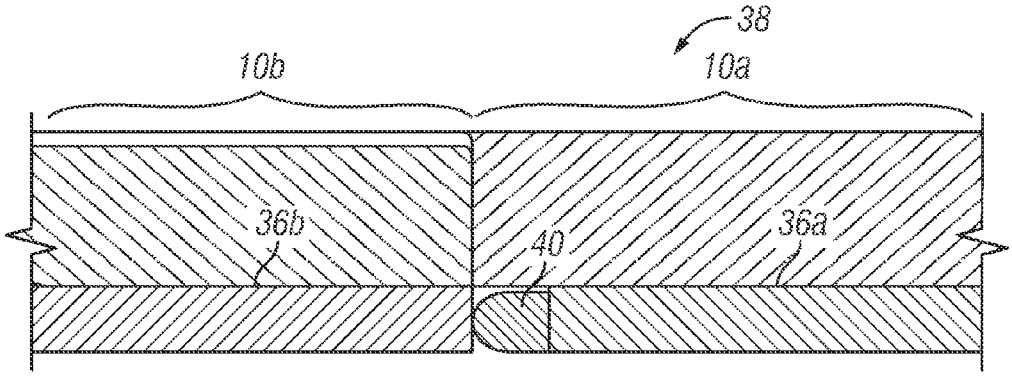
FIG. 5A-5G are cross-section views of another example of an electrical seal assembly for a joint-to-joint connection.

In other examples of sealing assembly 38, sealing element 40 and/or insulating layer 36 may have different contact profiles, including female and male contact interfaces 60 and 62 shown in FIGS. 4F-4H. For instance, as shown in FIG. 5A, sealing element 40 has a U-shaped cross section, to provide a flat interface with insulating layer 36*a* and a rounded interface with insulating layer 36*b*.

Figure 5B:
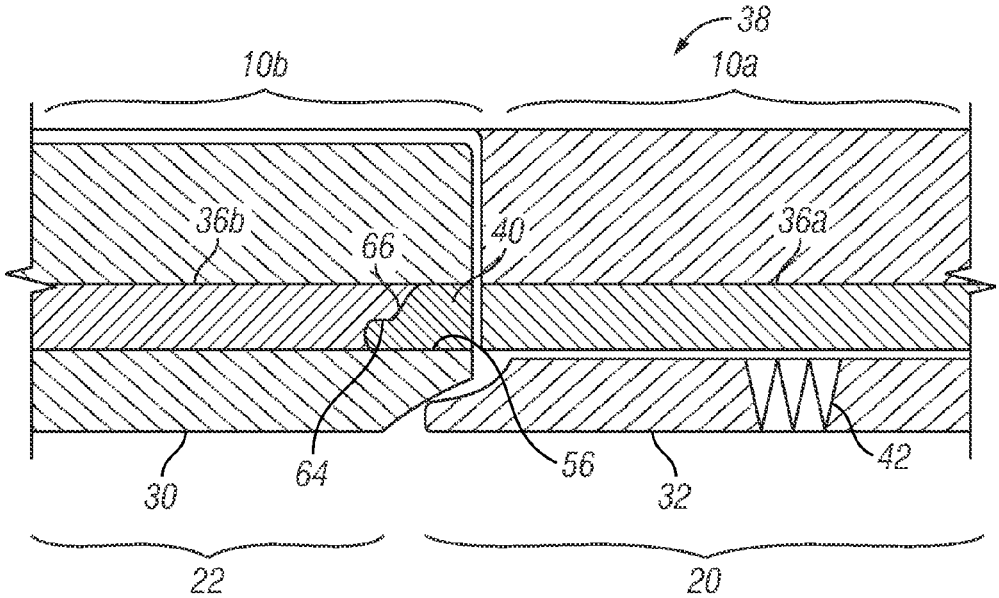

FIG. 5B shows another example of seal assembly 38 in a closed position. Sealing element 40 is in a recessed position within cavity 56. The box connection side of sealing element 40 has step cut 64 and insulating layer 36*b* has a matching step cut 66 on its pin connection side. This matching step cut connection will help hold sealing element 40 in place as the drill pipe joint is being disconnected. The matching step cut connection also provides a longer sealing surface on one side to reduce the change of seal failure on that side.

Figure 5C:
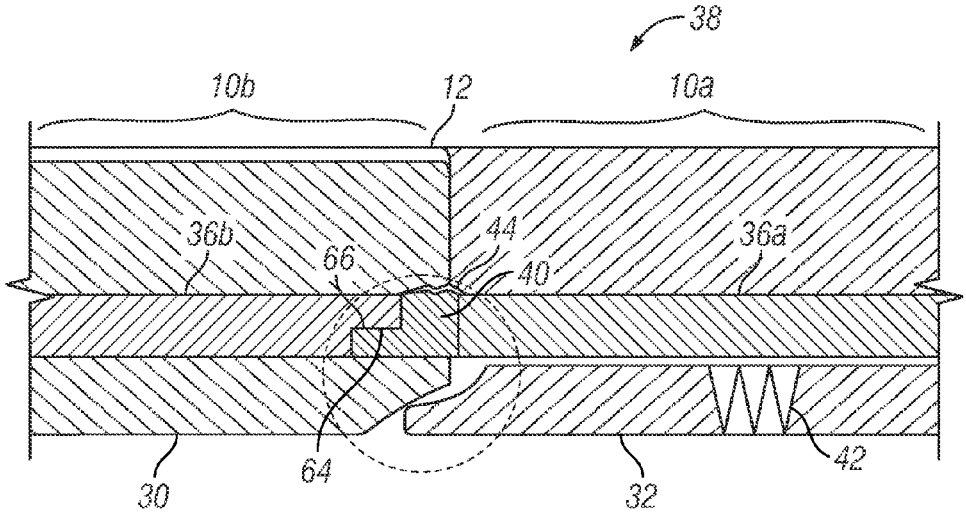
Figure 5D:
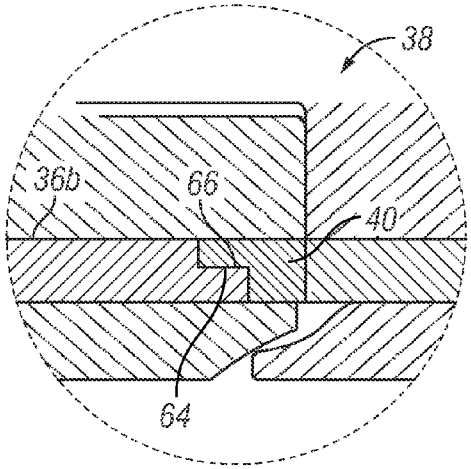
Figure 5E:
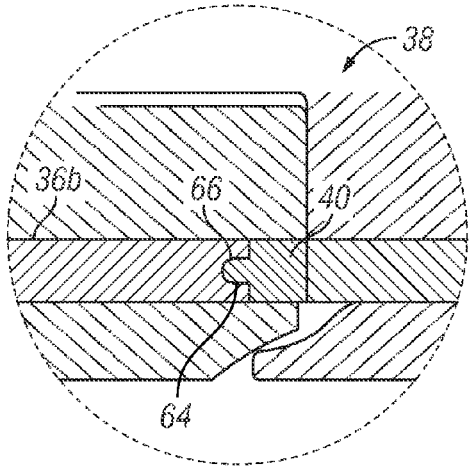

As shown in FIG. 5C, sealing element 40 may also be used in a seal assembly 38 having outer contact chamfers 44. FIGS. 5D and 5E show other examples of step cut profiles 64 and 66.

Figure 5F:
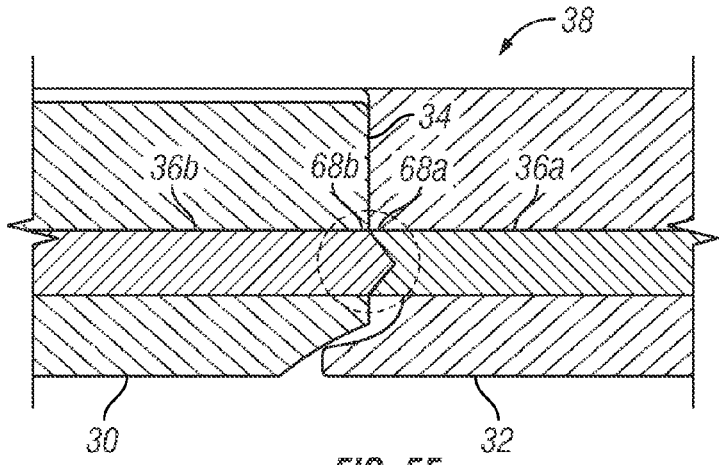
Figure 5G:
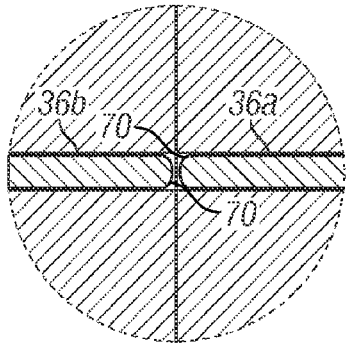

In some examples, seal assembly 38 does not include a sealing element 40 as insulating layers 36 may each be extended (to outer contact 34) and couple to form a seal. As shown in FIG. 5F, sealing assembly 38 includes extended insulating layers 36*b* and 36*a*. Extended insulating layers 36*b* and 36*a* include interlocking V-shaped interfaces 68*b* and 68*a*, respectively. In another example, shown in FIG. 5G, extended insulating layers 36*b* and 36*a* may have rounded interfaces 70.

Figure 6:
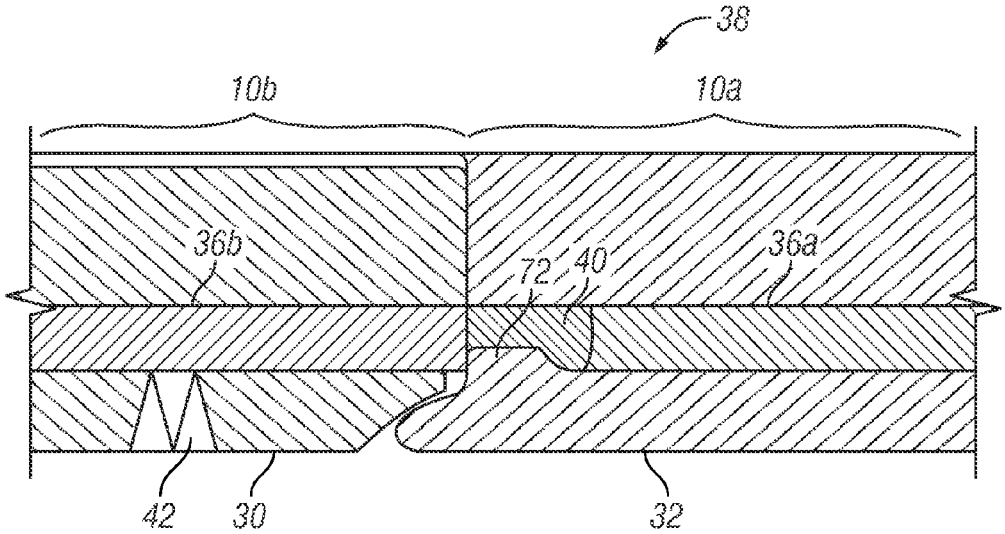
FIG. 6 is a cross-section view of another example a electrical seal assembly for a joint-to-joint connection.

FIG. 6 shows another example of seal assembly 38 in a closed position. In this example, second inner contact 32 includes wedge 72 to wedge or compress sealing element 40 onto sealing layer 36*a*. As second inner contact 32 is compressed by spring force 42, wedge 72 provides further squeezing of sealing element 40. In other examples, sealing element 40 may be a separate seal or molded onto second inner contact 32.

Figure 7A:
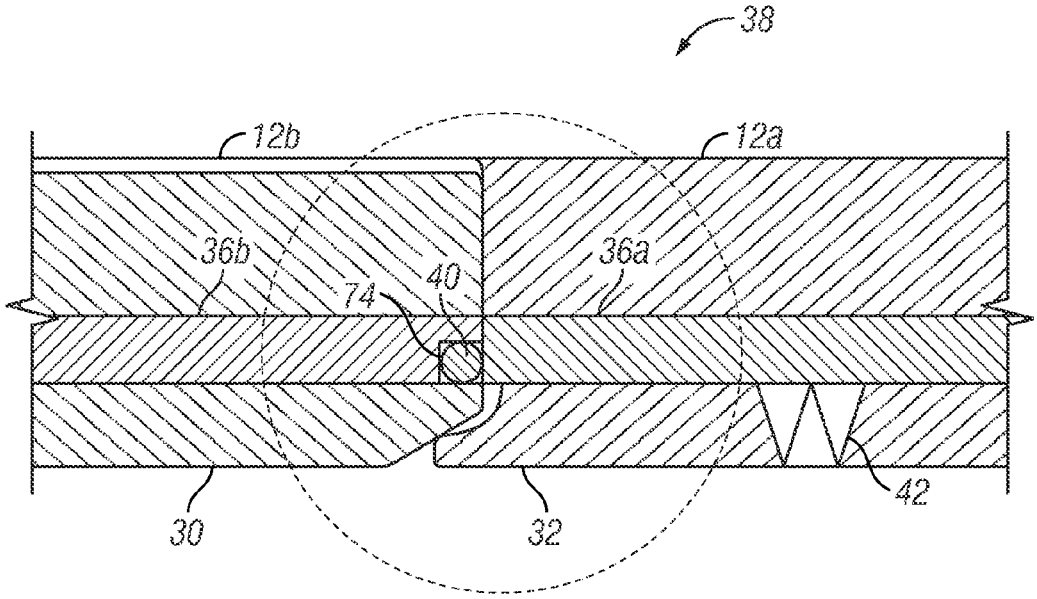
FIGS. 7A-7D are cross-section views of another example.

FIG. 7A shows another example of seal assembly 38 in a closed position. In this example, insulating layer 36*b* includes half dovetail 74 to retain sealing element 40 between the insulating layer 36*b* and first inner contact 30 (as shown in FIG. 7A) or outer conductor 12*b*.

Figure 7B:
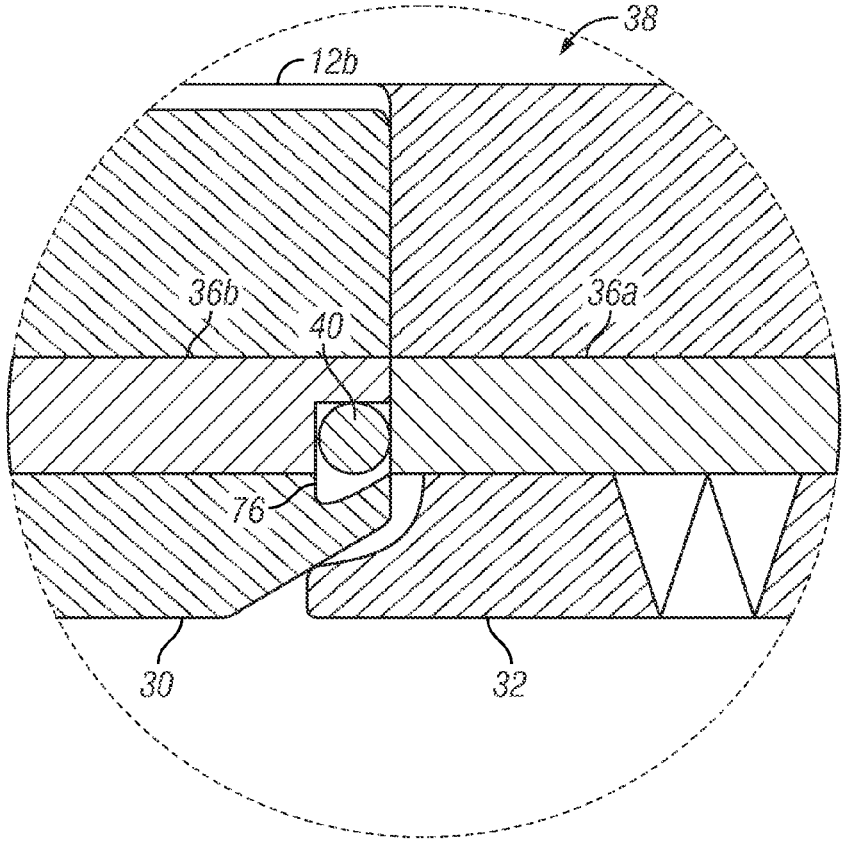

FIG. 7B shows another example of seal assembly 38 in a closed position. In this example, first inner contact 30 includes half dovetail 76 to retain sealing element 40 between first inner contact 30 and outer conductor 12*b*. In the examples shown in FIGS. 7A and 7B, sealing element 40 is secured in the pin side of the contact to allow easier access to sealing element 40 when the pipe is lifted into position, e.g., for repair or replacement.

Figure 7C:
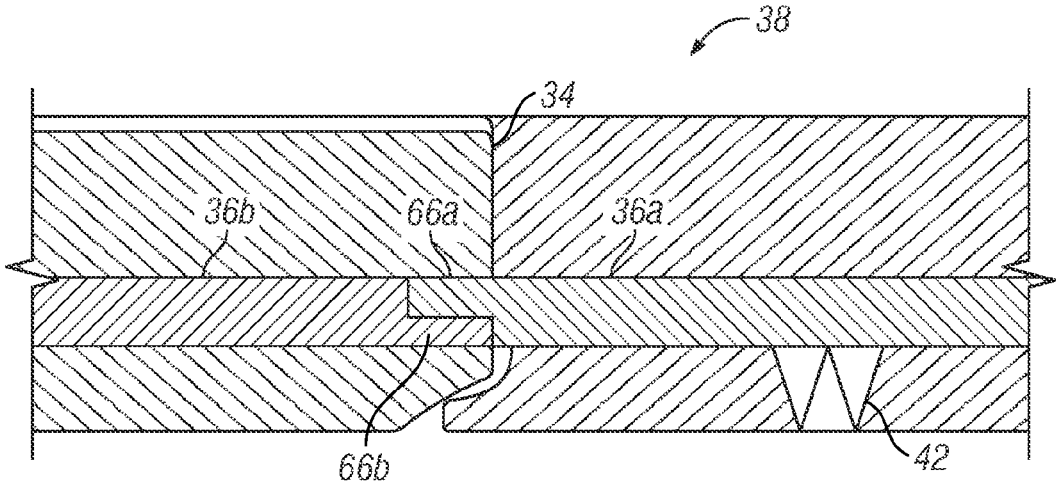
Figure 7D:
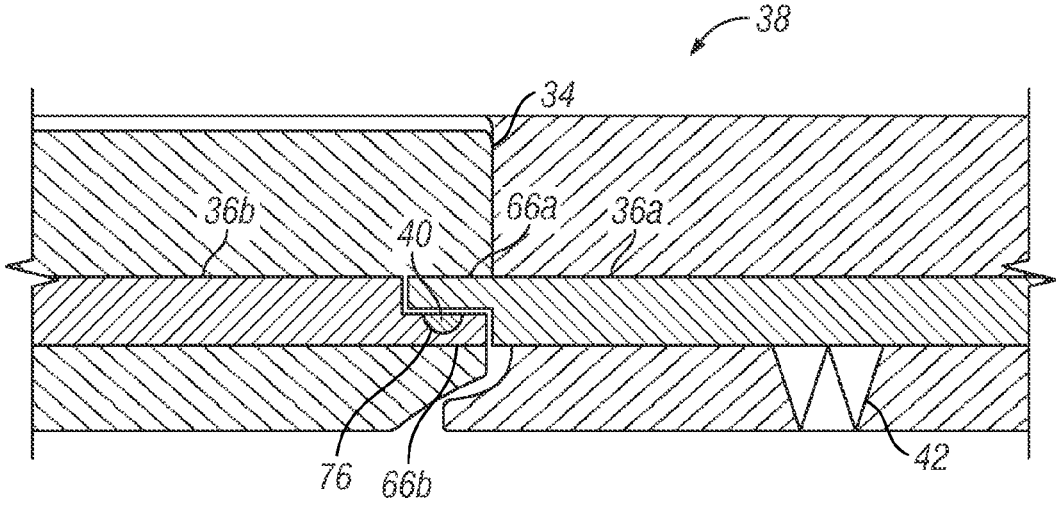

FIG. 7C shows another example of seal assembly 38 in a closed position. In this example, seal assembly 38 does not include a sealing element 40. Extended insulating layers 36*b* and 36*a* extend to, or past, outer contact 34. Insulating layers 36*b* and 36*a* couple via step cuts 66*a* and 66*b*. In FIG. 7D, extended insulating layer 36*b* includes recess 76 to retain sealing element 40 between extended insulating layers 36*b* and 36*a*.

Figure 8B:
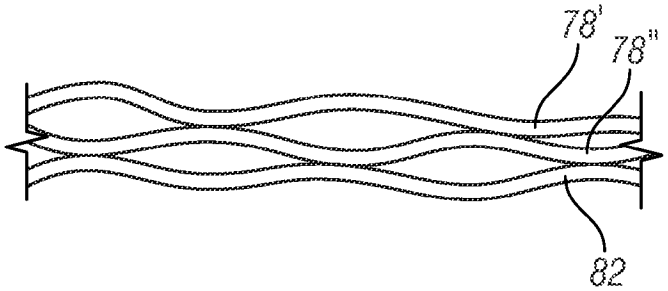
FIG. 8B is a conceptual side view of a portion of the contact of FIG. 8A in seal.
Figure 8A:
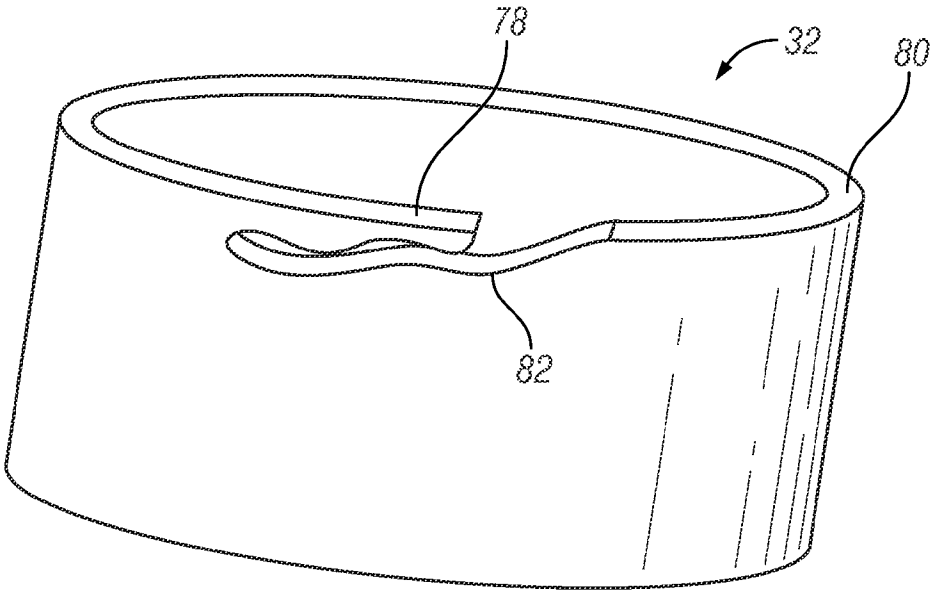
FIG. 8A is a perspective view of an example of a contact end of electrical seal assembly.

FIGS. 8A and 8B show an example of second inner contact 32 having a biasing or spring-type interface. In this example, second inner contact 32 includes spring finger 78 formed on contact face 80 of second inner contact 32 to provide a wave spring. The wave spring provides a spring force to allow second inner contact 32 to engage the first inner contact 30 of an adjacent joint 10 while maintaining the necessary forces during the full duration of the downhole operation. Spring forces may compensate for misalignment of joints 10 during assembly as well as misalignments created by temperature, shock and other factors. FIG. 8B shows finger 78 moving from an uncompressed position 78' to a compressed position 78". Bed 82 may be shaped to support or otherwise prevent finger 78 from being over stroked as finger 78 is being compressed to avoid excessive plastic deformation.

Figure 8C:
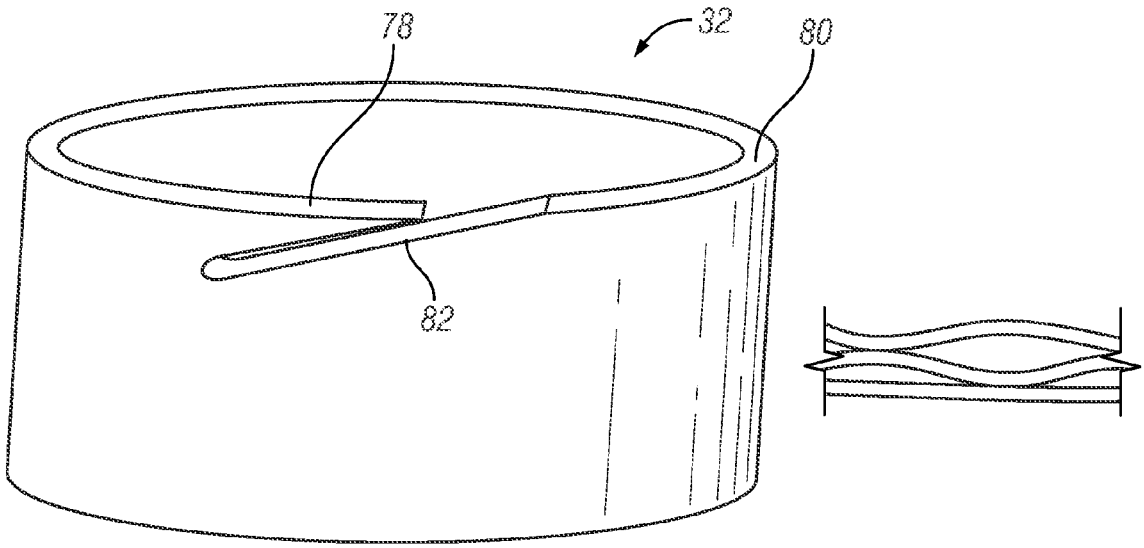
FIG. 8C is a perspective view of another example of a contact end of an example of an electrical seal assembly.
Figure 8D:
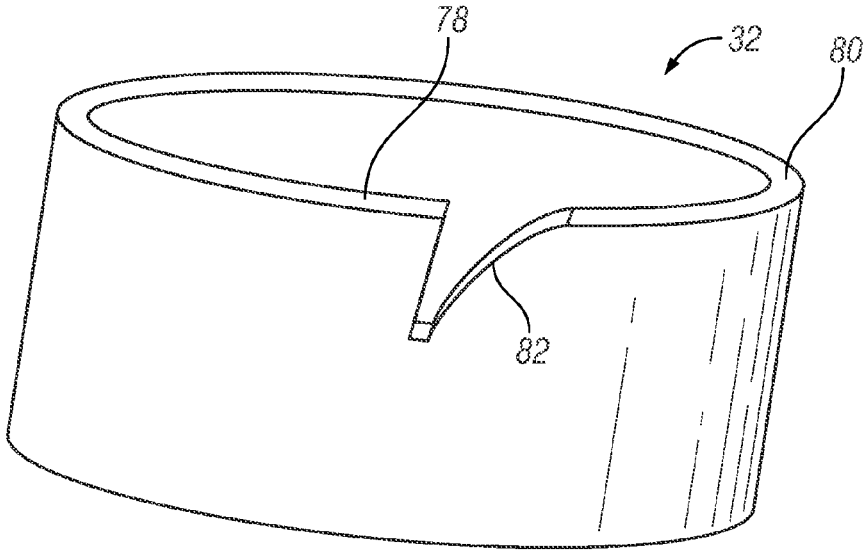
FIG. 8D is a perspective view of another example of a contact end of an example of an electrical seal assembly.

FIG. 8C shows another example of second inner contact 32 in which spring finger 78 is straight and formed at a shallow angle with respect to contact face 80. FIG. 8D shows another example of second inner contact 32 in which spring finger 78 is straight and formed at a steep angle with respect to contact face 80.

Figure 9A:
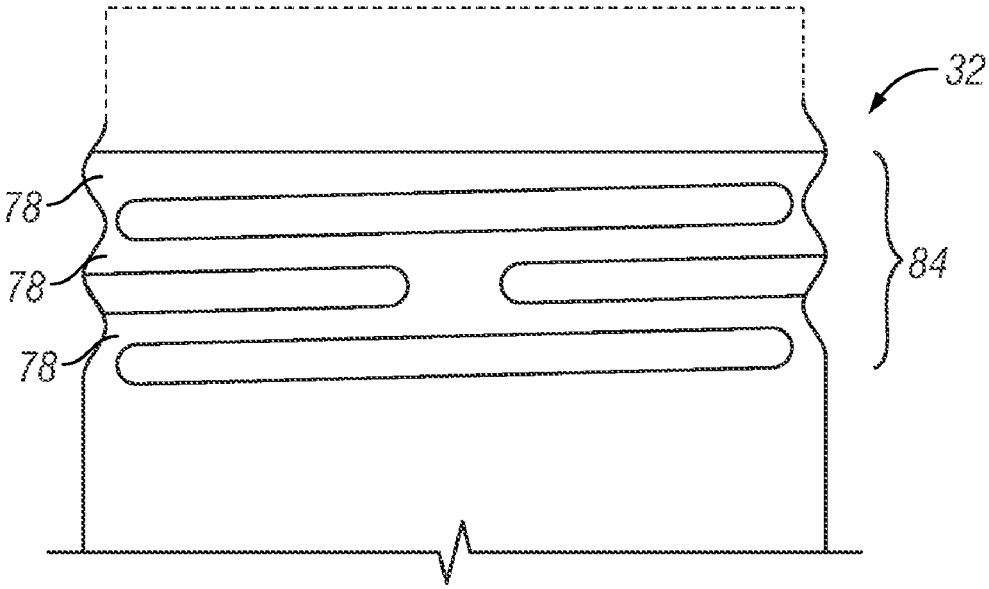
FIGS. 9A-9B are plan views of a contact end of an example of an electrical seal assembly.
Figure 9B:
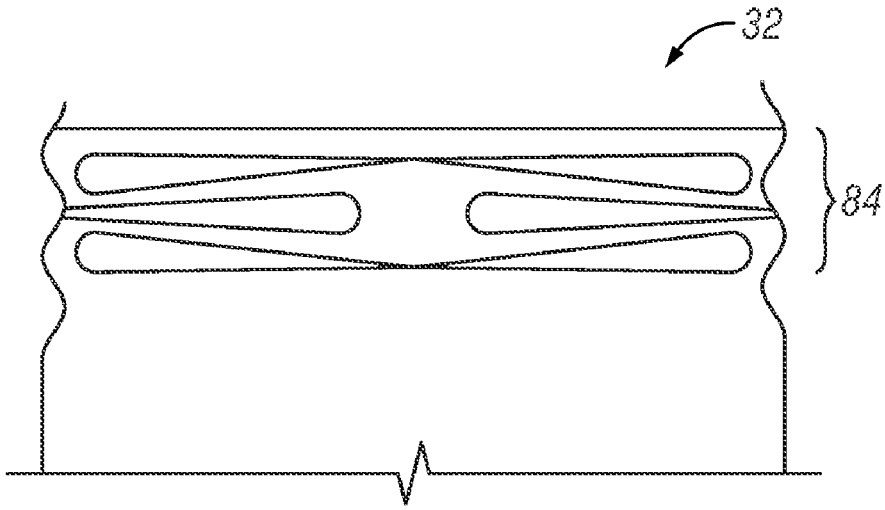

FIGS. 9A and 9B show another example of second inner contact 32 having a multi-turn wave spring 84 formed by one or more interconnected spring fingers 78 arranged in a ring about second inner contact 32. FIG. 9A shows second inner contact 32 in an open or uncompressed position. FIG. 9B shows second inner contact 32 in a closed or compressed position. Multi-turn wave spring 84 may act as a conductive member and may provide greater forces between first inner contact 30 and second inner contact 32. Multi-turn wave spring 84 may be a separate component coupled to second inner contact 32 or formed, for example by machining, directly on second inner contact 32.

Figure 9C:
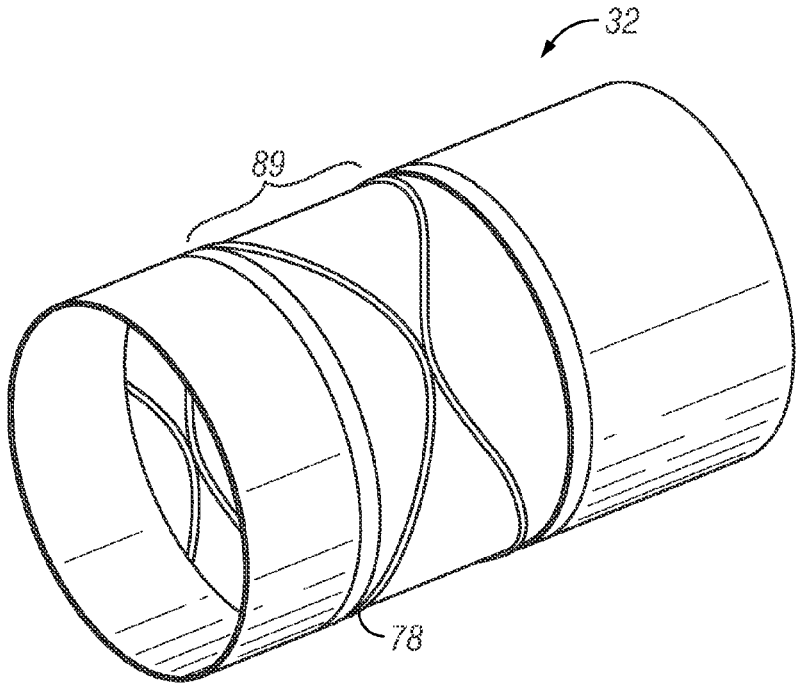
FIG. 9C is a perspective view of the contact end of FIGS. 9A and 9B.

FIG. 9C is a perspective view of second inner contact 32 shown in FIGS. 9A and 9B.

Figure 9D:
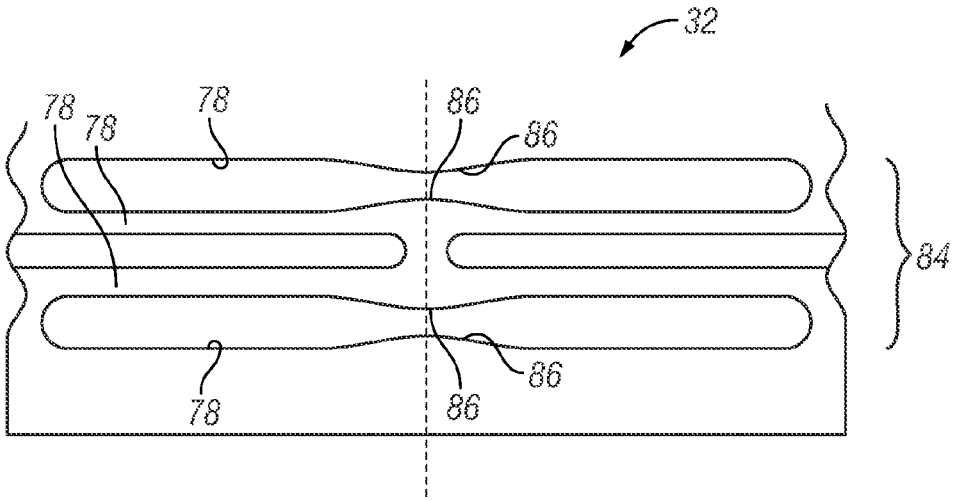
FIG. 9D is a plan view of an example of a contact in isolation.

FIG. 9D shows another example of second inner contact 32 having a multi-turn wave spring 84. In this example, one or more spring fingers 78 include humped portions 86 to control closure and push out debris.

Figure 10:
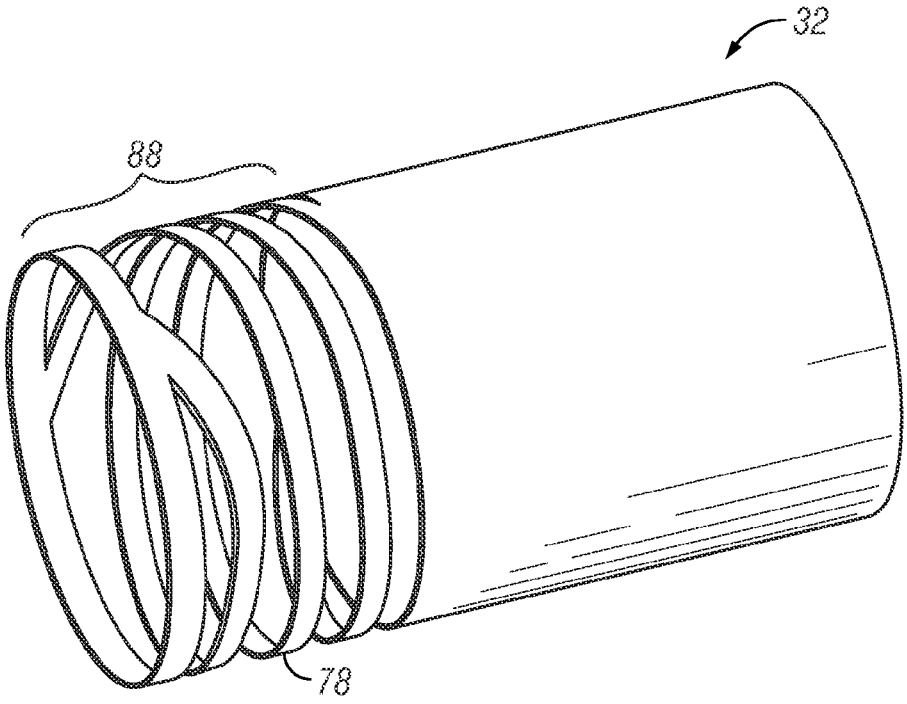
FIG. 10 is a perspective view of another example of a contact of an example of an electrical seal assembly having a spiral spring.

FIG. 10 is perspective view of second inner contact 32 having spiral spring 88 formed by one or more spring fingers 78 arranged in a spiral about second inner contact 32. Spiral spring 88 may create compression forces and handle over-torque conditions. Over-torque conditions may occur during the assembly of the system where clearing of debris may create an unexpectedly high torque load. As shown in FIG. 10, spiral spring 88 may have the tendency to open and press onto insulating layer 36 when being made up which may help prevent damage to spiral spring 88. Spiral spring 88 may have several starts to the spiral to provide several points of support to maximize the spring force and provide a more stable force to the contact between first inner contact 30 and second inner contact 32 during vibrations. The spiral spring 88 contact may be on the inner diameter of the joint 10. The spring fingers or coils 78 may be over-molded with an elastomer to create a smooth surface and reduce fluid flow resistance.

Figure 11:
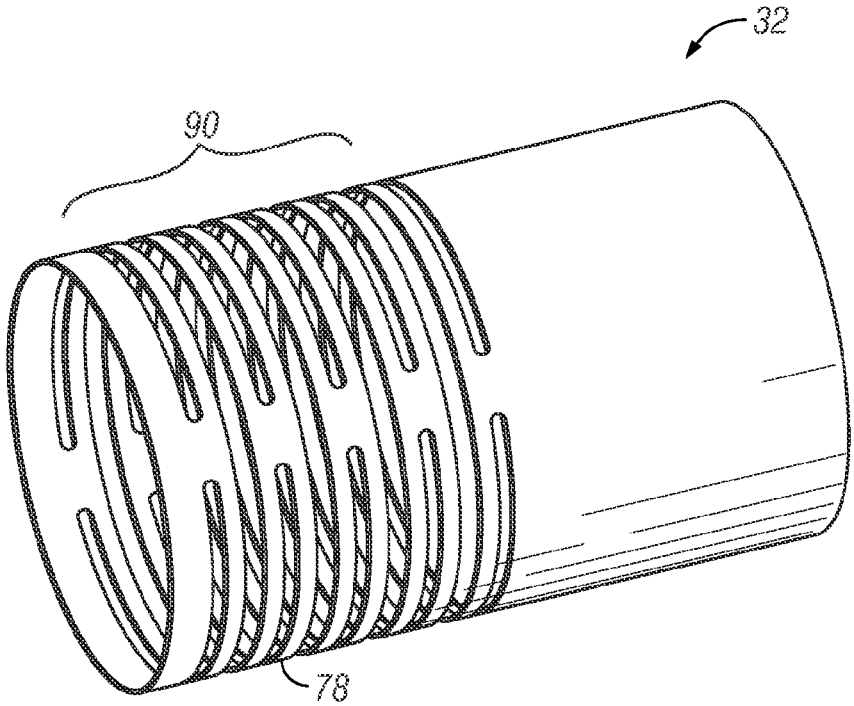
FIG. 11 is a perspective view, in isolation, of an example of a contact of an example of an electrical seal assembly forming an array of slots.

FIG. 11 is perspective view of second inner contact 32 having slot array 90 formed by one or more interconnected spring fingers 78 arranged in a slotted pattern about second inner contact 32. The slot shapes of slot array 90 may be optimized for stress as well as for providing a hard stop for slot spring fingers 78 above a maximum deflection. Spring fingers 78 may include humped portions 86 (as shown in FIG. 9D) to further control or limit deflection. The slot openings of slot array 90 may be filled with elastomer to improve the flow characteristics of the drill pipe.

Figure 12:
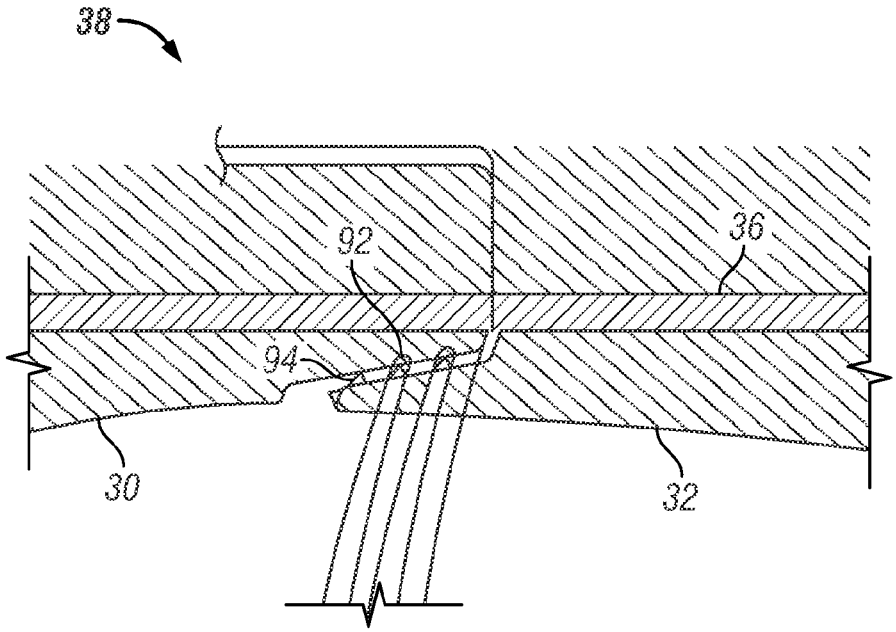
FIG. 12 is a cross-section view of an example of an electrical seal assembly.

FIG. 12 shows another example of seal assembly 38 in a closed position. In this example, first inner contact 30 and second inner contact 32 may include threading 92 and threading 94, respectively, to allow contacts 30 and 32 to be threadedly coupled. This type of connection may be made with or without spring force 42 as the threads 92 and 94 may engage and thread the needed contact resistance. The threaded connection may provide a smooth inner diameter for the drill pipe.

Figure 13A:
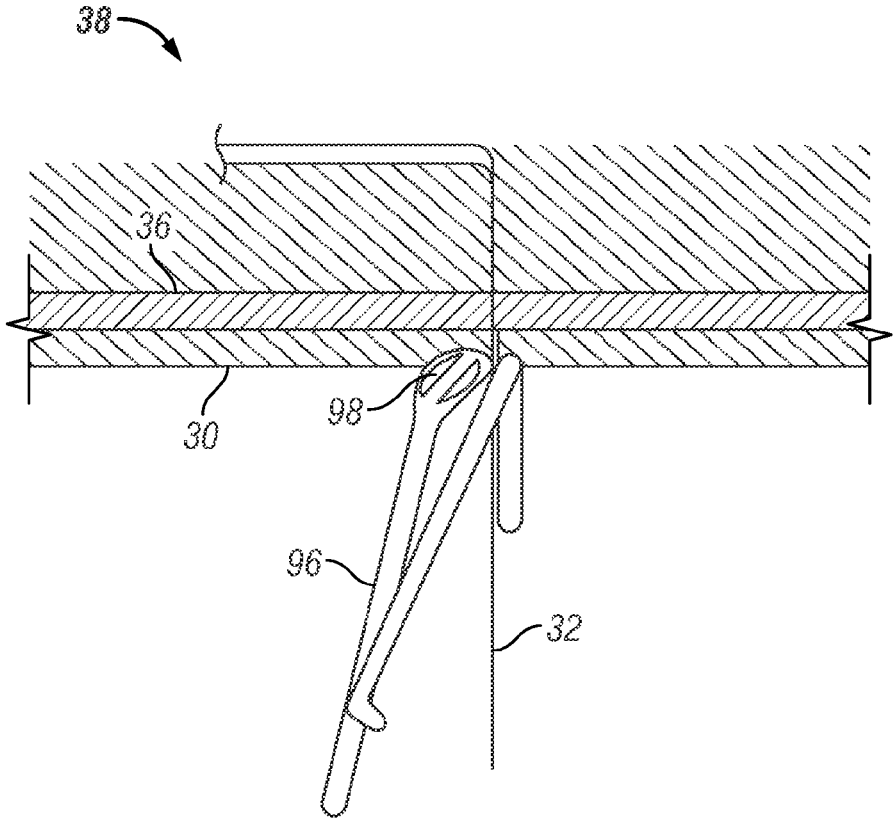
FIG. 13A is a cut away view of an electrical seal assembly in a joint-to-joint connection.
Figure 13B:
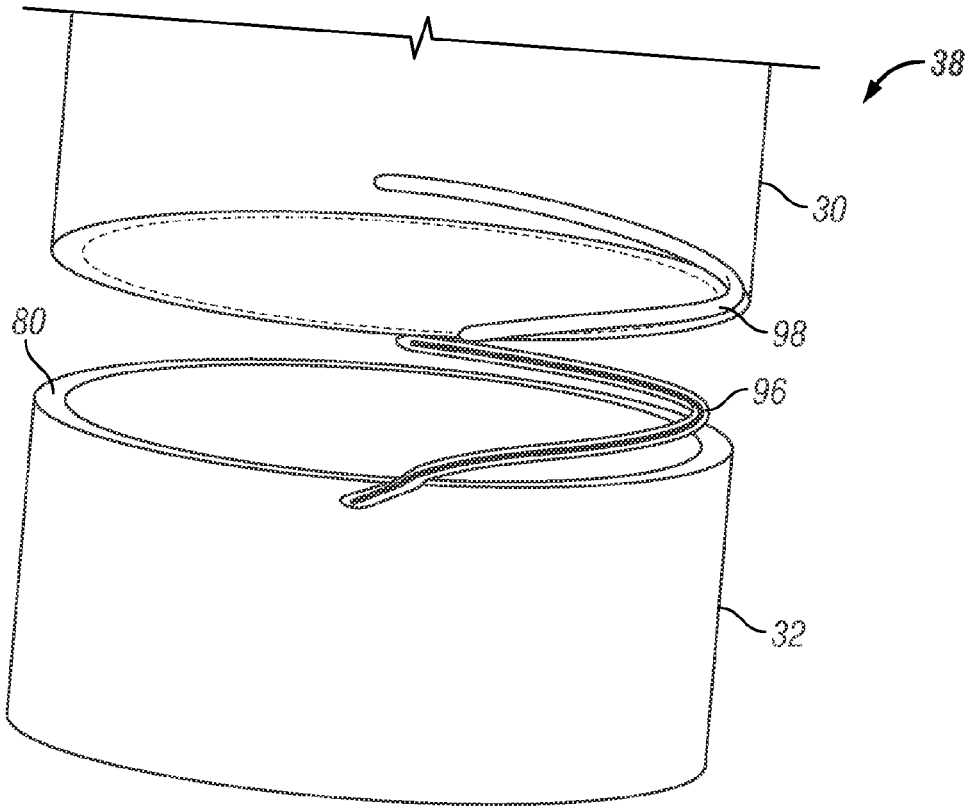
FIG. 13B is a perspective view of the inner contact of the electrical seal assembly of FIG. 13A shown in isolation.

FIGS. 13A and 13B show another example of seal assembly 38. In this example, second inner contact 32 includes a single or multi-turn wire 96 positioned on or about contact face 80. First inner contact 30 includes a threaded groove 98 formed on its inner diameter. During assembly, wire 96 may couple with groove 98 to allow contacts 30 and 32 to be connected, e.g., via a tension force instead of a compression force.

Figure 14A:
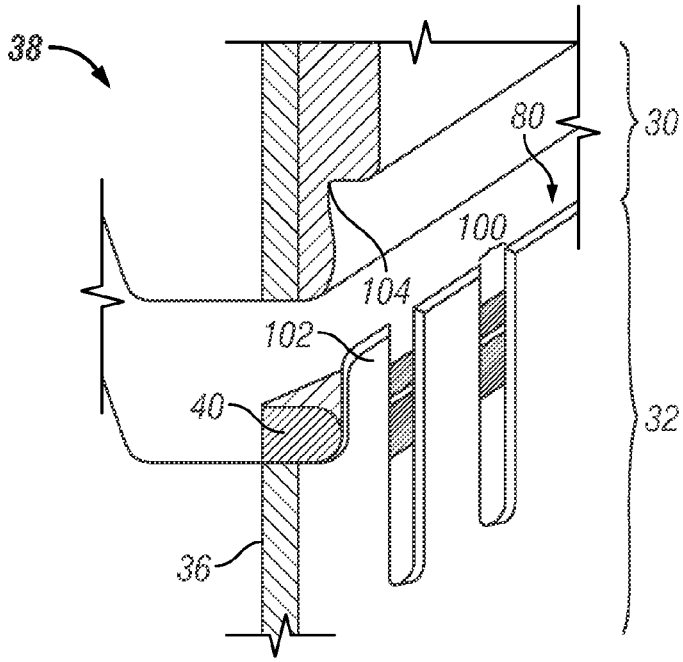
FIGS. 14A-14E are cross-section views of additional examples of an electrical seal assembly in which an inner contact has cantilever fingers.

FIG. 14A shows another example of seal assembly 38 in an open position. In this example, second inner contact 32 includes one or more slots 100 and cantilever fingers 102 on contact face 80. The face of each cantilever finger 102 may be rounded to ramp onto landing 104 of first inner contact 30. Cantilever fingers 102 may assist in removing debris from the contact area during assembly. The length and width of cantilever finger 102 may be selected to tailor the spring reactions. This design may provide greater manufacturing tolerance for the distance between contacts 30 and 32. Slots 100 may be oriented to the fluid flow and may be filled with an elastomer to provide a smooth inner diameter to fluid flow.

Figure 14B:
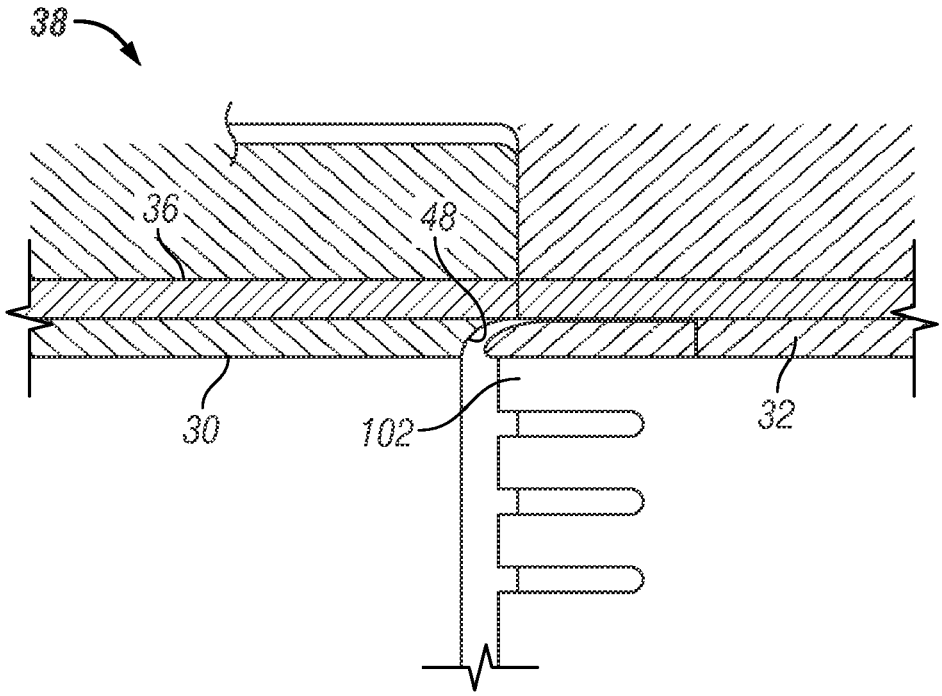

FIG. 14B shows another example of seal assembly 38 in an open position. In this example, second inner contact 32 may contact, but does not overlap, the ramp 48 of first inner contact 30. This design may allow for a thinner assembly than an overlap design (as shown in FIG. 14A), but may require the contact distances to be more controlled.

Figure 14C:
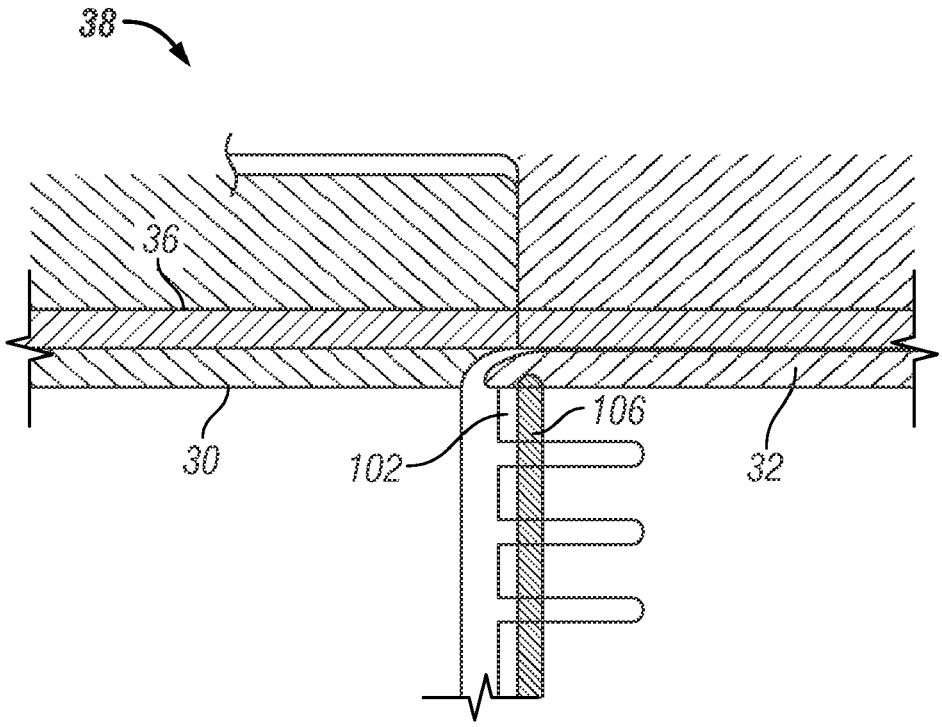

In the example shown in FIG. 14C, second inner contact 32 includes spring ring 106 positioned proximate to fingers 102, e.g., either inside or outside contact 32. Spring ring 106 may allow for thin fingers 102 of any material as the spring ring 106 may provide most of the desired spring force for coupling contacts 30 and 32.

Figure 14D:
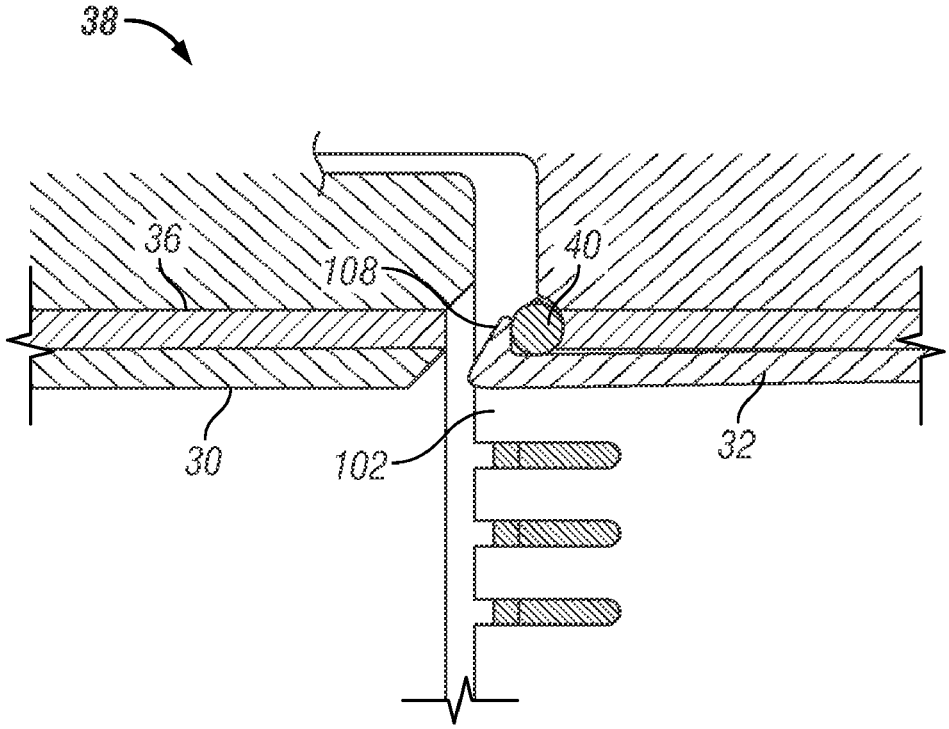
Figure 14E:
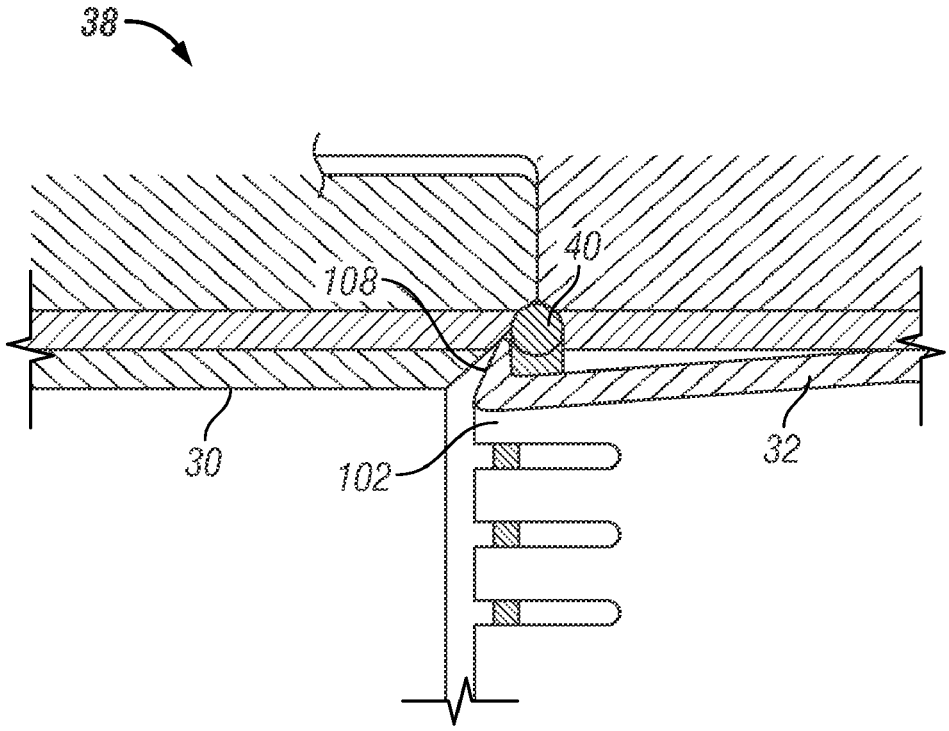

FIGS. 14D and 14E show another example of seal assembly 38, shown in open and closed positions, respectively. In this example, second inner contact 32 includes cantilever fingers 102 having ridge 108 to capture sealing element 40 when seal assembly 38 is opened.

Figure 15A:
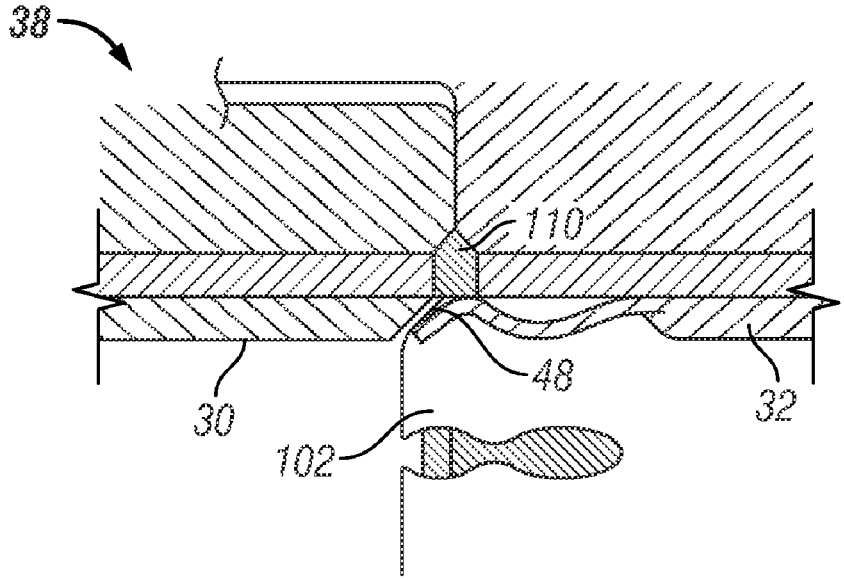
FIGS. 15A-15B are cross-section views of an examples of an electrical seal assembly in a joint-to-joint connection.
Figure 15B:
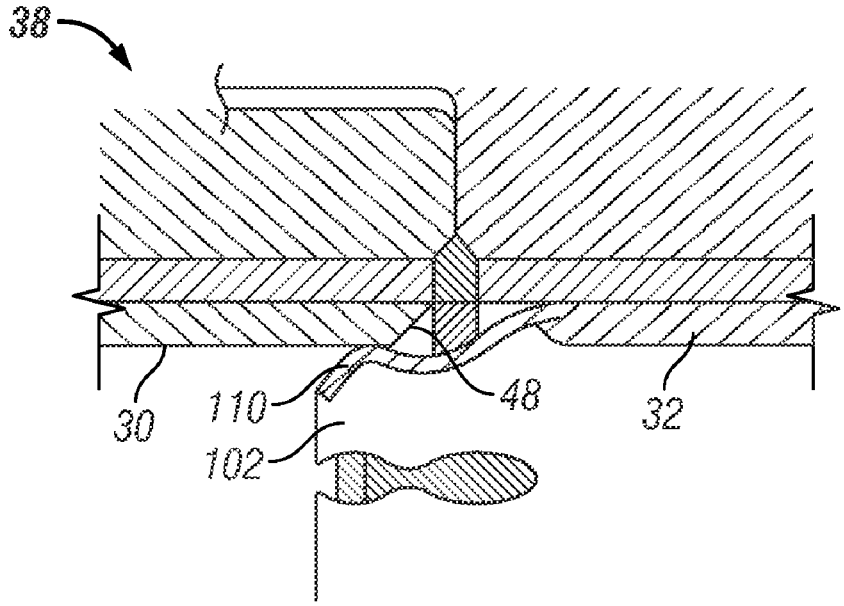

FIGS. 15A and 15B show another example of seal assembly 38 in a closing and fully closed position, respectively. In this example, cantilever fingers 102 have ramping face 110 to contact ramp 48 (FIG. 15A) and then deform finger 102 to form an overlapping connection with first inner contact 30 (FIG. 15B).

Figure 16A:
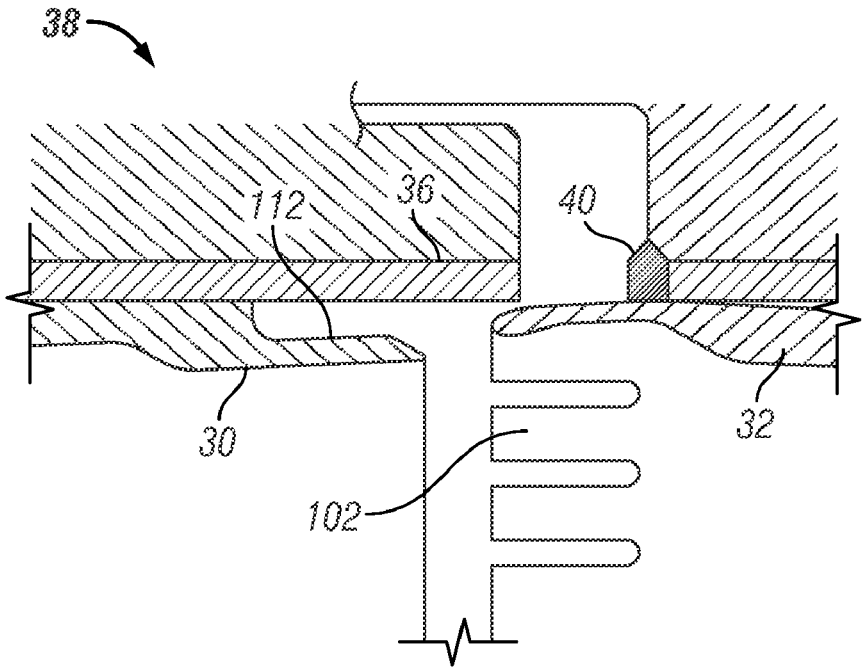
FIGS. 16A-16B are cross-section views of another example of an electrical seal assembly in a joint-to-joint connection.
Figure 16B:
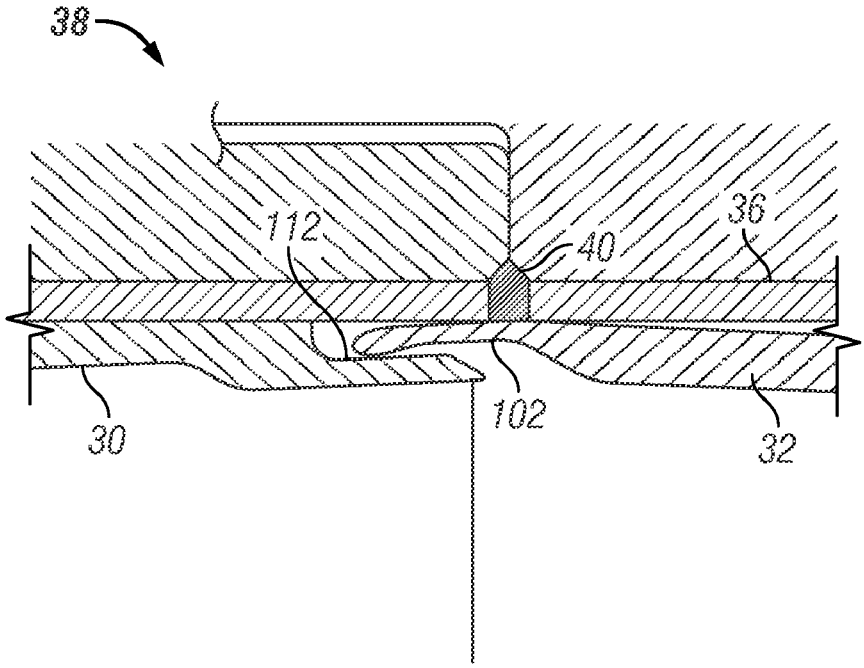

FIGS. 16A and 16B show another example of seal assembly 38, shown in open and closed positions, respectively. In this example, first inner contact 30 includes captive ramp face 112. As second inner contact 32 is coupled to first inner contact 30, cantilever fingers 102 are captured by captive ramp face 112 (between first inner contact 30 and insulating layer 36. As a result, sealing element 40 is protected from the inner diameter of the wired pipe assembly once the assembly is made up due to the overlapping coverage.

Figure 17:
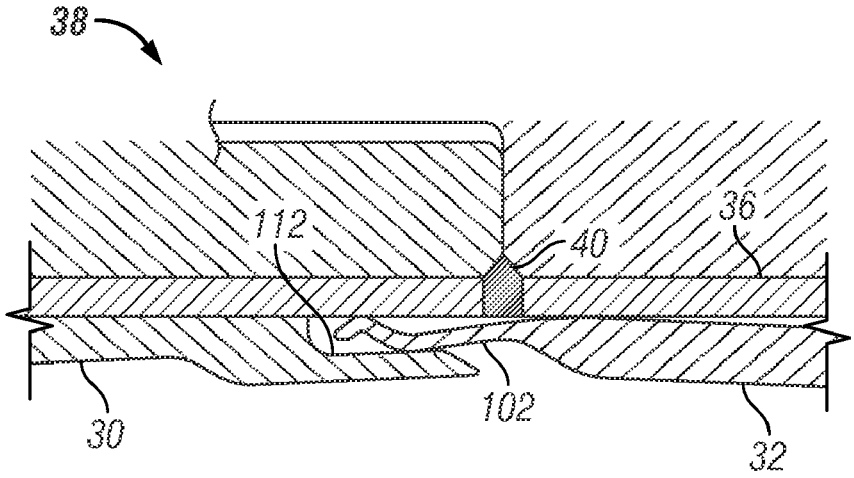
FIG. 17 is a cross-section view of another example of an electrical seal assembly in a joint-to-joint connection.

FIG. 17 shows another example of seal assembly 38. In this example, cantilever fingers 102 are wave shaped to provide additional points of contact against captive ramp 112 and/or insulating layer 36 to thereby create greater coupling force.

Figure 18:
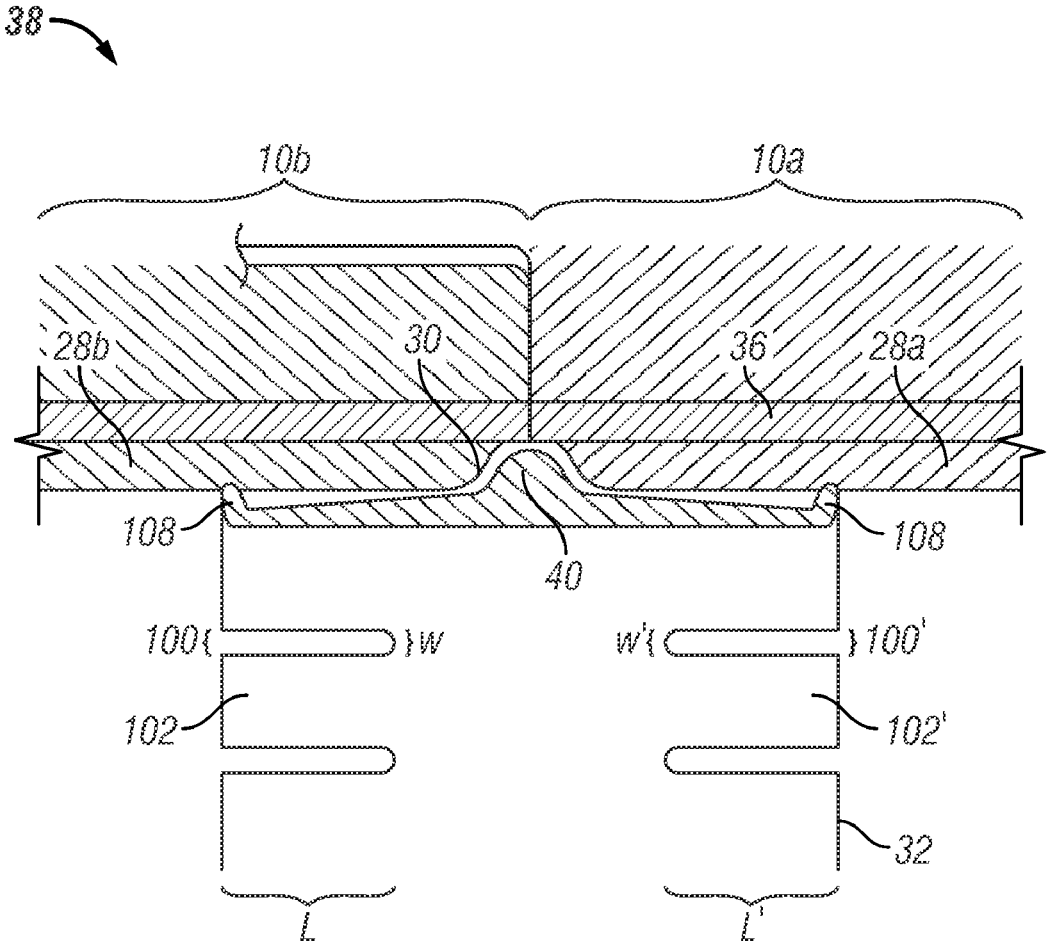
FIG. 18 is a cross-section view of a joint-to-joint connection using an example of an electrical seal assembly.

FIG. 18 shows another example of seal assembly 38 in which second inner contact 32 is anchored to the inner conductors 28 using a spring fit. This spring fit is provided by fingers 102 having ridges 108. The length L or width W of slots 100 on one side of second inner contact 32 may be different from those of the other end of second inner contact 32 so that fingers 102 and 102' provide different spring forces against conductors 28*b* and 28*a*, respectively. For example, where L' is less than L, fingers 102' provide more spring force (e.g., stiffer) than fingers 102 to keep second inner contact 32 retained to joint 10*a* when joints 10*a* and 10*b* are disconnected. This spring fit allows contact 32 to be quickly replaced in the field as needed. Furthermore, second inner contact 32 includes sealing element 40 molded around the outer diameter of contact 32. In this example, the whole assembly (contact 32 and molded sealing element 40) may be quickly removed for replacement or to allow the inner conductor 28 at the inner contact face to be quickly cleaned.

Figure 19:
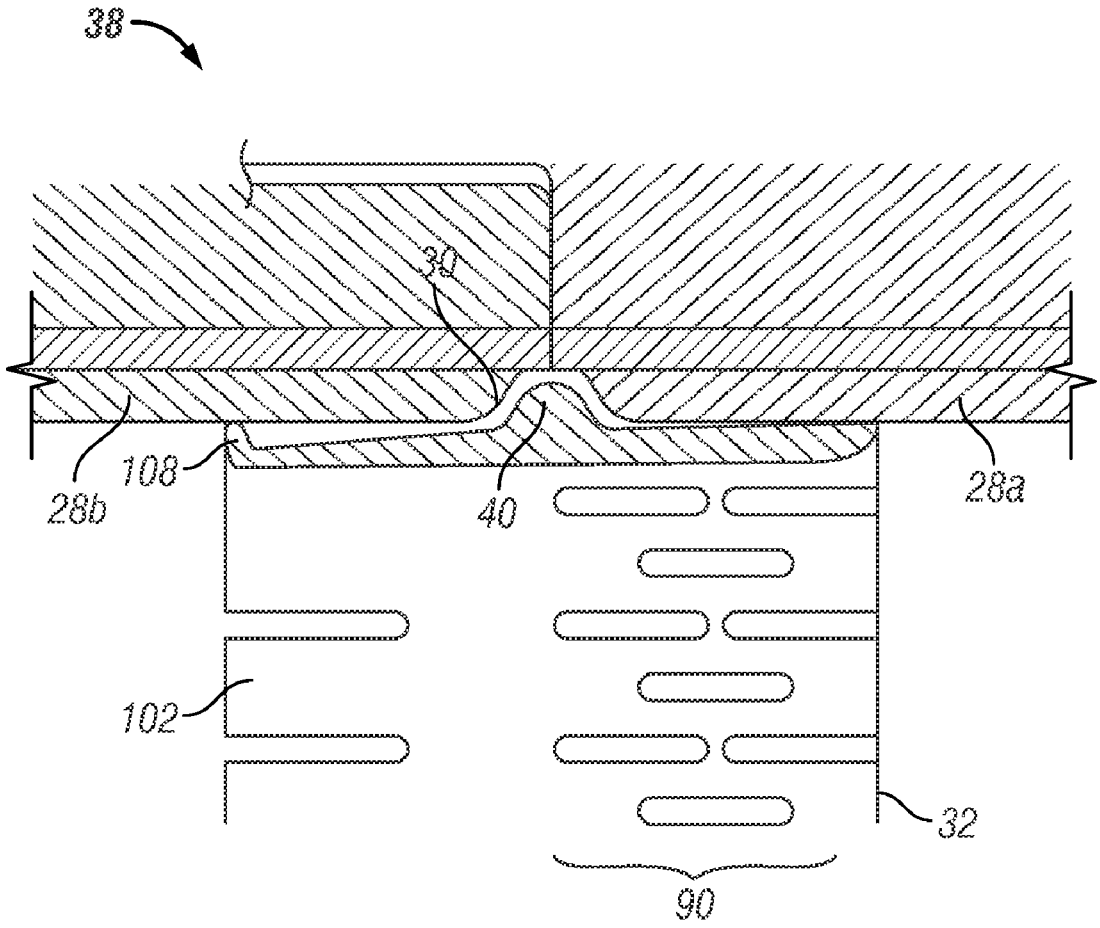
FIG. 19 is a cross-section view of a joint-to-joint connection using an example of an electrical seal assembly.

FIG. 19 shows another example of seal assembly 38 which includes both a radial spring and slot spring to provide different spring forces. One side of second inner contact 32 includes fingers 102, while the other side includes slot array 90.

Other methods of anchoring second inner contact 32 to inner conductors 28 include soldering, welding (such as spot welding, metal inert gas (MIG) welding, tungsten inert gas (TIG) welding, ultrasonic welding, and friction welding), conductive glue, and interference fitting, among other examples.

Figure 20A:
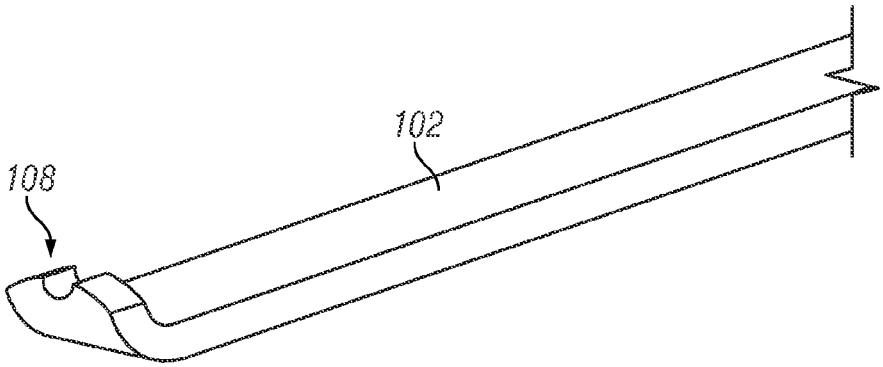
FIGS. 20A-20B are partial views of the fingers of FIGS. 15-18 shown in isolation.
Figure 20B:
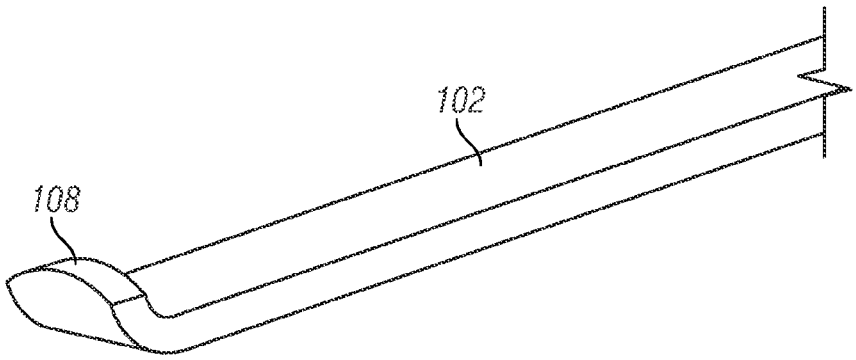

FIGS. 20A and 20B show additional examples of finger 102. FIG. 20A shows finger 102 having a multi-support ridge 108. This example reduces rotations by providing two or more contact points and allows debris to fall through. FIG. 20B shows finger 102 having a crested ridge 108. This example allows finger 102 to slide over notching on the opposing side of the interface (such as groove 98 shown in FIGS. 13A and 13B, for example).

Figure 21A:
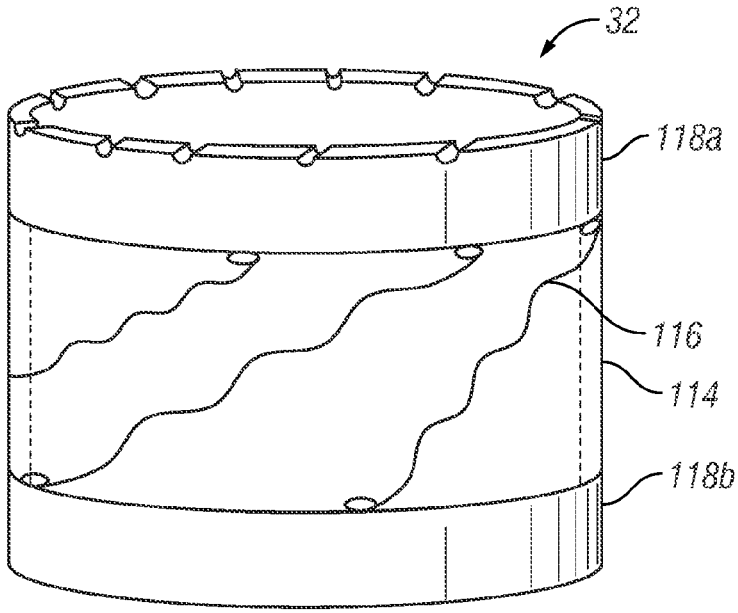
FIG. 21A is a perspective view of an inner contact, having a wired encapsulating layer, of an electrical seal assembly shown in isolation.
Figure 21B:
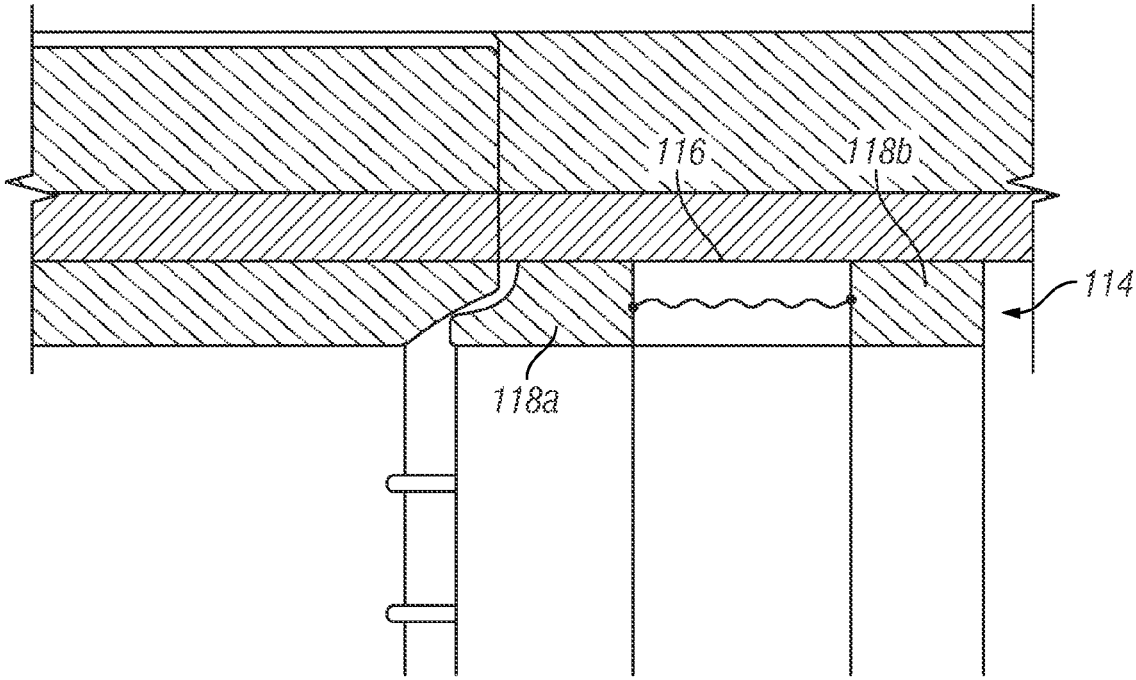
FIG. 21B is a cross-section view a joint-to-joint connection utilizing an inner contact of FIG. 21A.

FIGS. 21A and 21B show another example of second inner contact 32. Second inner contact 32 has encapsulation 114 formed around the outside of contact 32. Encapsulation 114 may provide a spring force to anchor contact 32 against inner conductor 28. Encapsulation may include a conductive or non-conductive elastomer over-molding. Encapsulation 114 may include embedded wires 116 connected to metal rings 118 to maintain an electrical connection through second inner contact 32.

Figure 22:
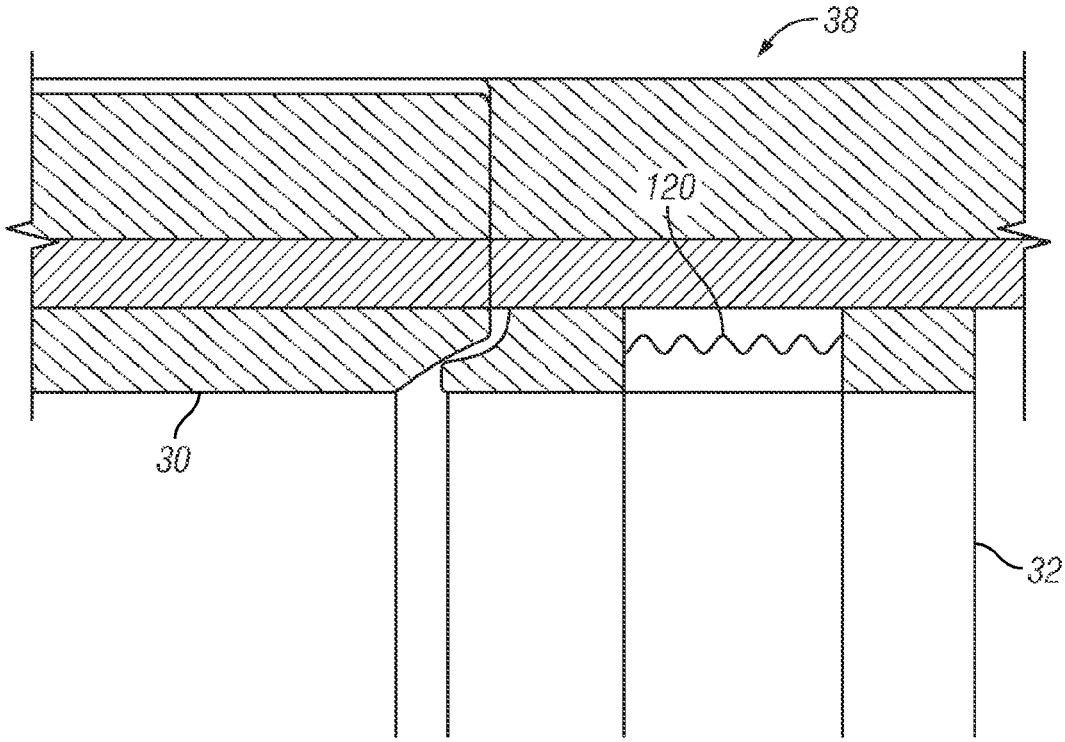
FIG. 22 is a cross-section view of another example of a joint-to-joint connection utilizing an electrical seal assembly.

FIG. 22 shows another example of seal assembly 38 in which second seal assembly 32 includes a spring bellows body 120 to provide a spring force. Spring bellows body 120 may allow for larger torques and deflections. Spring bellows body 120 may include an elastomer coating to provide a smoother surface.

Figure 23A:
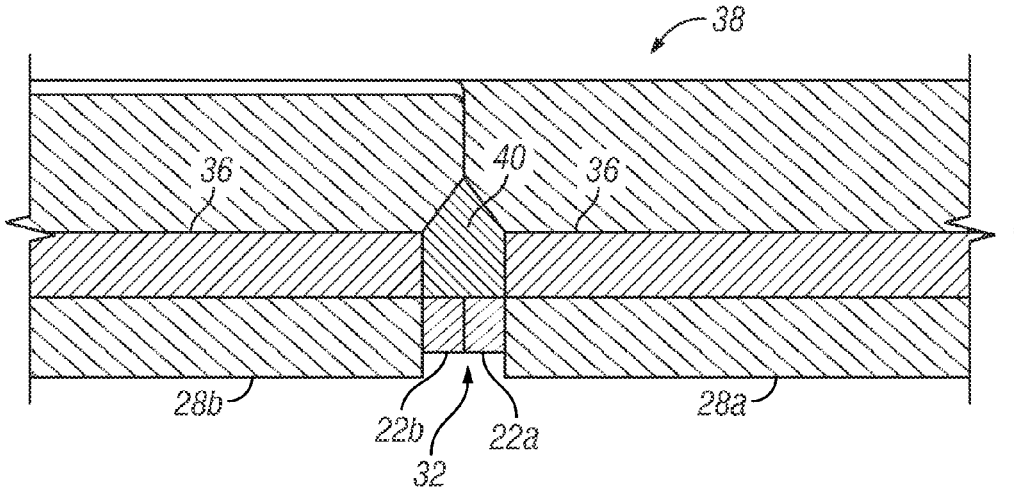
FIG. 23A is a cross-section view of an example of joint-to-joint connection utilizing an electrical seal assembly.
Figure 23B:
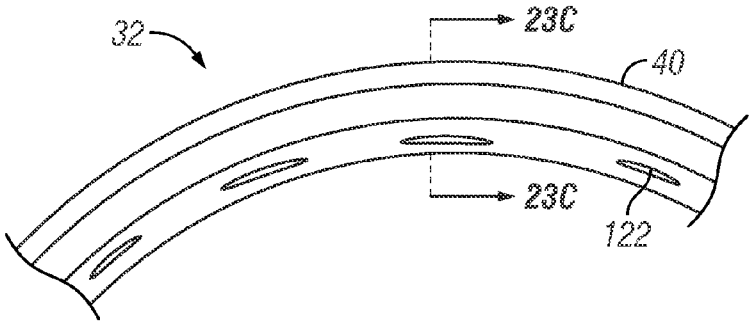
FIG. 23B is an end view of portion of the seal member of FIG. 23A.
Figure 23C:
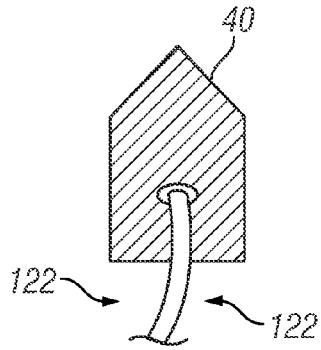
FIG. 23C is an exploded view of a cross-section of the seam member of FIGS. 23A-23B.

FIGS. 23A-23C shows another example of seal assembly 38. Second inner contact 32 comprises a spring finger disk having sealing element 40 positioned on the outer diameter and conductive contact springs 122 positioned on the inner diameter. When installed, sealing element 40 will seal the insulating layer 36 and contact springs 122 will contact the face of inner conductors 28. Because second inner contact 32 does not protrude into the pipe inner diameter, the pipe inner diameter may be flush.

From the foregoing detailed description of specific embodiments of the invention, it should be apparent that a system for electrical connections between drill pipes that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A tubular for connecting with substantially identical adjacent tubulars to form a string of wired tubulars, the tubular comprising:

a tubular body having an axial bore, a box end, and a pin end, the box end configured to mate with the pin end of an adjacent tubular and the pin end configured to mate with the box end of another adjacent tubular;

an inner conductor extending between the pin end and box end, the inner conductor having a first inner contact and a second inner contact;

an outer conductor extending between the pin end and the box end, the outer conductor having a first outer contact and a second outer contact;

an electric insulator positioned between the inner conductor and the outer conductor; and an isolation assembly to electrically isolate the inner conductor from the outer conductor when the pin end is connected to the box end of the adjacent tubular, wherein the isolation assembly comprises: a seal member; and means for compressing the seal member compressed between electric insulators of the connected tubulars.

2. The tubular of claim 1, wherein the isolation assembly comprises:

a first mating interface formed on the first inner contact; and a second mating interface formed on the second inner contact operationally connectable with first mating interface.

3. A tubular for connecting with substantially identical adjacent tubulars to form a string of tubulars, the tubular comprising:

a tubular body having an axial bore, a box end, and a pin end, the box end configured to mate with the pin end of an adjacent tubular and the pin end configured to mate with the box end of another adjacent tubular;

an inner conductor extending between the pin end and box end, the inner conductor having a first inner contact and a second inner contact, the first and second inner contacts exposed to the tubular interior fluids;

an outer conductor extending between the pin end and the box end, the outer conductor having a first outer contact and a second outer contact, the first and second outer contacts exposed to the tubular interior fluids;

an electric insulator positioned between the inner conductor and the outer conductor; and means for electrically isolating the inner conductor from the outer conductor when the pin end is connected to the box end of the adjacent tubular, wherein the electrical isolation means comprises: a seal member; and means for compressing the seal member compressed between electric insulators of the connected tubulars.

4. The tubular of claim 3, wherein the electrical isolation means comprises:

a first face formed on an end of the electric insulator; and a second face formed on the opposing end of the electric insulator, wherein the first interface the second interface are configured to mate and form a substantially continuous insulation layer across the connected tubulars.

5. The tubular of claim 3, wherein the compressing means comprises:

a first chamfer formed on the first outer contact; and a second chamfer formed on the second outer contact.

6. The tubular of claim 3, wherein the compressing means includes a wedge formed by the second inner contact.

7. The tubular of claim 3, wherein the electrical isolation means comprises:

a first mating interface formed on the first inner contact; and a second mating interface formed on the second inner contact operationally connectable with first mating interface.

8. The tubular of claim 7, wherein the first and second mating interfaces are cantilever fingers.

9. The tubular of claim 7, wherein the first and the second mating interfaces are corresponding tapered faces.

10. The tubular of claim 7, wherein the first mating interface is a female-type contact and the second mating interface is a male-type contact.

11. The tubular of claim 7, further including notches formed on the first inner contact.

12. A wired tubular string, the string comprising:

a first joint having an axial bore, a box end, a pin end, a concentric inner conductor, and a concentric outer conductor;

a second joint having an axial bore, a box end, a pin end, a concentric inner conductor and a concentric outer conductor;

a joint-to-joint connection formed at the connection of the pin end of the second joint with the box end of the first joint; and an isolation assembly positioned at the joint-to-joint connection to operationally connect the corresponding concentric inner conductors and the corresponding concentric outer conductors across the joint-to-joint connection and electrically isolate the inner conductor from the outer conductor, wherein the isolation assembly comprises: a seal member; and means for compressing the seal member compressed between electric insulators of the connected tubulars.

13. The string of claim 12, wherein the isolation assembly comprises:

a first mating interface formed on the first inner contact; and a second mating interface formed on the second inner contact operationally connectable with first mating interface.

14. A tubular for connecting with substantially identical adjacent tubulars to form a string of wired tubulars, the tubular comprising:

a tubular body having an axial bore, a box end, and a pin end, the box end configured to mate with the pin end of an adjacent tubular and the pin end configured to mate with the box end of another adjacent tubular;

an inner conductor extending between the pin end and box end, the inner conductor having a first inner contact and a second inner contact;

an outer conductor extending between the pin end and the box end, the outer conductor having a first outer contact and a second outer contact;

an electric insulator positioned between the inner conductor and the outer conductor; and an isolation assembly to electrically isolate the inner conductor from the outer conductor when the pin end is connected to the box end of the adjacent tubular;

wherein the isolation assembly comprises a means for forcing the inner contacts into engagement with one another when the tubulars are connected, the forcing means formed on one of the inner contacts.

* * * * *